US011636967B2

(12) United States Patent
Kawasaki et al.

(10) Patent No.: US 11,636,967 B2
(45) Date of Patent: Apr. 25, 2023

(54) COIL DEVICE

(71) Applicant: TDK CORPORATION, Tokyo (JP)

(72) Inventors: Yoshihiro Kawasaki, Tokyo (JP); Masato Otsuka, Tokyo (JP); Taishi Kitamura, Tokyo (JP)

(73) Assignee: TDK CORPORATION, Tokyo (JP)

( * ) Notice: Subject to any disclaimer, the term of this patent is extended or adjusted under 35 U.S.C. 154(b) by 319 days.

(21) Appl. No.: 17/000,963

(22) Filed: Aug. 24, 2020

(65) Prior Publication Data

US 2021/0065954 A1 Mar. 4, 2021

(30) Foreign Application Priority Data

Aug. 30, 2019 (JP) ..... JP2019-159034

(51) Int. Cl.

| | |
|---|---|
| ***H01F 17/00*** | (2006.01) |
| ***H01F 27/28*** | (2006.01) |
| ***H01F 27/29*** | (2006.01) |
| ***H01F 17/04*** | (2006.01) |

(52) U.S. Cl.

CPC ..... *H01F 17/045* (2013.01); *H01F 27/2828* (2013.01); *H01F 27/292* (2013.01)

(58) Field of Classification Search

CPC ... H01F 17/045; H01F 27/2828; H01F 27/292
See application file for complete search history.

(56) References Cited

U.S. PATENT DOCUMENTS

| | | | | |
|---|---|---|---|---|
| 6,472,969 | B1 * | 10/2002 | Hanato | H01F 17/045 336/200 |
| 7,358,842 | B1 * | 4/2008 | Liu | H01F 38/10 336/200 |
| 2002/0057160 | A1 * | 5/2002 | Hanato | H01F 27/292 336/83 |
| 2004/0263285 | A1 * | 12/2004 | Suzuki | H01F 41/082 333/185 |
| 2005/0052267 | A1 * | 3/2005 | Singu | H01F 27/292 336/83 |
| 2006/0170526 | A1 * | 8/2006 | Okumura | H01F 27/292 336/208 |
| 2010/0214050 | A1 * | 8/2010 | Opina, Jr. | H01F 27/292 29/606 |

(Continued)

FOREIGN PATENT DOCUMENTS

| | | | | |
|---|---|---|---|---|
| CN | 107068332 A | * | 8/2017 | H01F 1/342 |
| JP | 2006-049383 A | | 2/2006 | |
| JP | 2009147158 A | * | 7/2009 | |

*Primary Examiner* — Mohamad A Musleh
*Assistant Examiner* — Malcolm Barnes
(74) *Attorney, Agent, or Firm* — Oliff PLC

(57) ABSTRACT

A coil device has a core including a winding core portion and a flange portion formed on an X-axis-direction end portion of the winding core portion, a coil portion formed by wires being wound around the winding core portion, and terminal electrodes provided on the flange portion. Leadout portions of the wires are respectively connected to the terminal electrodes. A main protuberance having a protuberating shape is formed on an upper surface of the flange portion. The first and second leadout portions of the wires are connected to the first and second terminal electrodes outside the main protuberance in the X-axis direction.

20 Claims, 14 Drawing Sheets

(56) References Cited

U.S. PATENT DOCUMENTS

| | | | | |
|---|---|---|---|---|
| 2012/0133469 | A1* | 5/2012 | Tomonari | H01F 27/292<br>336/192 |
| 2015/0042434 | A1* | 2/2015 | Bando | B65H 75/06<br>242/613.3 |
| 2016/0133377 | A1* | 5/2016 | Takagi | H01F 27/29<br>29/605 |
| 2017/0069425 | A1* | 3/2017 | Yamakita | H01F 41/076 |
| 2018/0211764 | A1* | 7/2018 | Komaya | H01F 17/04 |
| 2019/0244744 | A1* | 8/2019 | Takenaka | H01F 27/29 |

* cited by examiner

COIL DEVICE

BACKGROUND OF THE INVENTION

1. Field of the Invention

The present invention relates to a coil device.

2. Description of the Related Art

For example, a common mode choke coil disclosed in JP2006-49383A is known as a coil device used for an inductor or the like. In the common mode choke coil disclosed in JP2006-49383A, a flange portion is formed in an end portion of a winding core portion in a first direction (winding axis direction) and two leg portions are formed at both ends of the flange portion in a second direction (direction orthogonal to the first direction). A terminal electrode is formed for each leg portion. Respective end portions of two windings wound around the winding core portion are connected to the terminal electrodes.

However, in the common mode choke coil disclosed in JP2006-49383A, the leadout positions of the winding end portions are likely to be unstable and contact to each other and a short circuit defect may arise.

SUMMARY OF THE INVENTION

The invention has been made in view of such circumstances, and an object of the invention is to provide a coil device capable of preventing the occurrence of a short circuit defect.

In order to achieve the object, a coil device according to the invention includes:

- a core including a winding core portion and a flange portion formed in an end portion of the winding core portion in a first direction;
- a coil portion formed by wires being wound around the winding core portion; and
- terminal electrodes provided on the flange portion, leadout portions of the wires being respectively connected to the terminal electrodes, wherein a main protuberance having a protuberating shape is formed on a first surface of the flange portion where at least a part of one of the terminal electrodes is disposed, and
- the leadout portions of the wires are connected to the terminal electrodes respectively outside the main protuberance in the first direction.

In the coil device according to the invention, the main protuberance having the protuberating shape is formed on the first surface of the flange portion where at least a part of one of the terminal electrodes is disposed. Accordingly, at the position where the main protuberance is formed, the height of the first surface of the flange portion is higher than the other portion of the first surface, so that it is difficult for the leadout portions of the wires positioned therearound to climb onto the same portion of the first surface of the flange portion. Accordingly, the leadout portions of the wires are unlikely to come into contact with each other around the main protuberance and it is possible to prevent the occurrence of a short circuit defect.

In general, in a case where the leadout portion of the wire is loose (lifted from the core), connection of the terminal electrode of the first surface to a mounting substrate in that state may lead to a contact between the loose part and the mounting substrate, so that a short circuit defect occurs. However, in a case where the flange portion is provided with the main protuberance, it is possible to shift the position of the leadout portion of the wire to a position separated from the mounting substrate by the distance that corresponds to the amount of protuberating of the main protuberance when the terminal electrode of the first surface is connected to the mounting substrate. Accordingly, it is difficult for the loose part to come into contact with the mounting substrate and it is possible to prevent the occurrence of a short circuit defect.

In addition, the leadout portion of the wire is connected to one of the terminal electrodes outside the main protuberance in the first direction in the coil device according to the invention. In this case, the leadout portion of the wire is capable of abutting against (can be fixed to) the main protuberance or the periphery thereof and can be drawn out to the terminal electrode while being positioned at that side. Accordingly, it is possible to stabilize the leadout position of the leadout portion of the wire, loosening (lifting) of the leadout portion of the wire is suppressed, and it is difficult for the leadout portion of the wire to climb onto the higher portion of the first surface of the flange portion. Accordingly, it is possible to avoid contact between the leadout portions of the wires and prevent the occurrence of a short circuit defect.

Preferably, the main protuberance is positioned within a region psitioned between one of the leadout portions of the wires and another one of the leadout portions of the wires. In this configuration, one of the leadout portions of the wires drawn out on one side of the main protuberance and the other leadout portion of the wires drawn out on the other side of the main protuberance are unlikely to climb onto the same portion of the first surface of the flange portion and it is possible to avoid contact between the leadout portions of the wires and effectively prevent the occurrence of a short circuit defect.

Preferably, a sub protuberance as well as the main protuberance is formed on the first surface and the sub protuberance is positioned on one end side in a second direction perpendicular to the first direction. In this configuration, it is possible to align the maximum heights of the first surface of the flange portion on one end side in the second direction where the sub protuberance is positioned and the position where the main protuberance is formed (such as the other end side of the first surface in the second direction), so that the coil device can be stably connected onto the mounting substrate.

Preferably, a first inclined portion is formed on the flange portion to extend at an angle to be inclined with respect to the second direction perpendicular to the first direction toward a third direction perpendicular to the first direction and a second direction. In this configuration, the leadout portion of the wire can be drawn out to the terminal electrode along the first inclined portion. In addition, at the position where the first inclined portion is formed, the inside corner of the flange portion is removed, and thus it is possible to prevent a situation in which the leadout portion of the wire is caught in the corner, so that the insulation coating thereof is not damaged when the leadout portion of the wire is drawn out from the winding core portion toward the terminal electrode.

Preferably, the first inclined portion has an inclined surface increasing in width in the first direction from a starting end of the first inclined portion toward a terminal end of the first inclined portion, and the inclined surface is formed to have a width extending from a vicinity of an outer end surface of the flange portion to an inner end surface of the flange portion at a portion of the terminal end of the first inclined portion. In this configuration, the inclined surface that is deeply inclined from the first-direction inner side of the flange portion to the first-direction outer side of the flange portion is formed and it is possible to draw out the leadout portion of the wire to the vicinity of the outer end surface of the flange portion along the first inclined portion.

The leadout portion of the wire is drawn out to the vicinity of the outer end surface of the flange portion as described above. As a result, the leadout portion of the wire is capable of abutting against (can be fixed to) the main protuberance or the periphery thereof and can be drawn out to the terminal electrode so as to be along the main protuberance or the periphery thereof while being positioned at that site as described above. Accordingly, it is possible to stabilize the leadout position of the leadout portion of the wire, loosening (lifting) of the leadout portion of the wire is suppressed, and it is difficult for the leadout portion of the wire to climb onto the higher portion of the first surface of the flange portion. Accordingly, it is possible to avoid a contact of the leadout portions of the wires and effectively prevent the occurrence of a short circuit defect.

Preferably, a second inclined portion is formed on the flange portion to extend to be inclined at an angle different from the angle of the first inclined portion, and the main protuberance is positioned within a region psitioned between the first inclined portion and the second inclined portion. In this configuration, the leadout portion of the wire drawn out along the first inclined portion positioned on one side of the main protuberance and the leadout portion of the wire drawn out along the second inclined portion positioned on the other side of the main protuberance are unlikely to climb onto the same portion of the first surface of the flange portion and it is possible to avoid a contact of the leadout portions of the wires and effectively prevent the occurrence of a short circuit defect.

Preferably, a width of the flange portion along the first direction at a side of the first surface is larger than a width of the flange portion along the first direction at a side of the second surface positioned on an opposite to the first surface. In this configuration, the volume of the flange portion can be larger than that of a hypothetical flange portion in which the first-direction widths of the first surface side of the flange portion and the second surface side of the flange portion are equal to each other. Accordingly, it is possible to realize the coil device that has satisfactory inductance characteristics.

In addition, on the second surface side, the inner end surface of the flange portion is disposed on the outer side in the first direction as compared with the first surface side. Accordingly, it is possible to separate the leadout position of the leadout portion of the wire extending from the second surface side toward one of the terminal electrodes and the other leadout portion of the wire extending from the second surface side toward another one of the terminal electrodes, avoid a contact of the leadout portions of the wires, and effectively prevent the occurrence of a short circuit defect.

In addition, for example, the leadout portion of the wire can be fixed to the vicinity of the inner end surface of the flange portion on the first surface side and the leadout portion of the other wire can be fixed to the vicinity of the inner end surface of the flange portion on the second surface side, and thus the respective leadout portions of the wires can be positioned with ease.

BRIEF DESCRIPTION OF THE DRAWINGS

FIG. 2D is a perspective view illustrating a step that follows the step of

DETAILED DESCRIPTION OF THE PREFERRED EMBODIMENTS

Figure 1A:
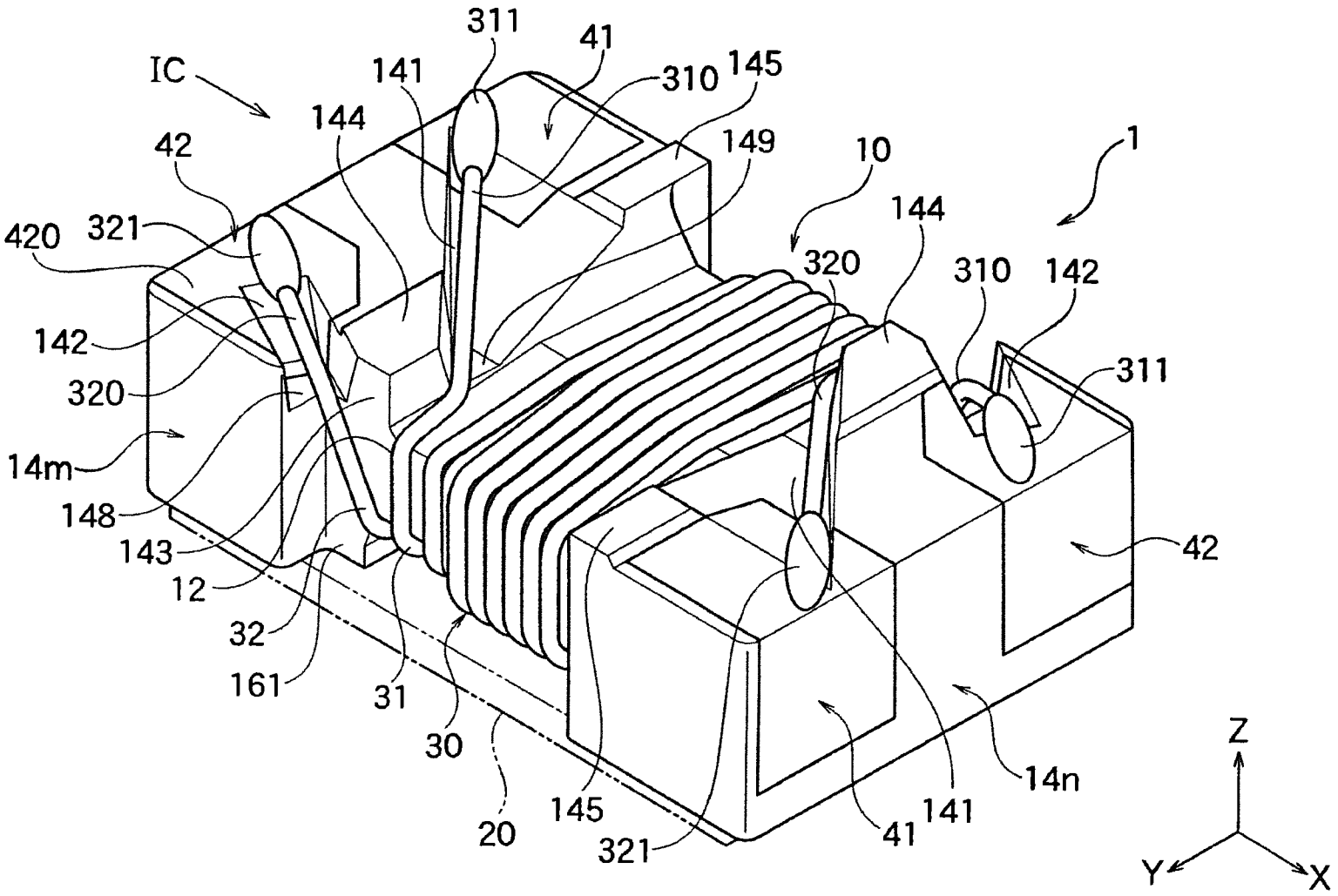
FIG. 1A is an overall perspective view of a coil device according to an embodiment of the invention.

Hereinafter, the invention will be described based on the embodiment that is illustrated in the drawings.

As illustrated in FIG. 1A, a coil device 1 according to one embodiment of the invention has a drum core 10 and a coil portion 30 wound around a winding core portion 12 of the drum core 10.

The X axis in the following description indicates a direction (first direction) parallel to the winding axis of the winding core portion 12 of the drum core 10 in a plane parallel to a mounting surface where the coil device 1 is mounted. As in the case of the X axis, the Y axis in the following description is in the plane parallel to the mounting surface and is a direction (second direction) perpendicular to the X axis. The Z axis in the following description is the normal direction of the mounting surface (third direction).

The drum core 10 has the winding core portion 12 and a pair of flange portions 14*m* and 14*n* provided at both ends of the winding core portion 12 in the X-axis direction. The flange portion (first flange portion) 14*m* is provided on one axial (first-direction) end portion of the winding core portion 12. The flange portion (second flange portion) 14*n* is provided on the other axial end portion of the winding core portion 12 and faces the first flange portion 14*m*. Although the flange portions 14*m* and 14*n* have the same shape, the flange portions 14*m* and 14*n* may be different in shape from each other. In the present embodiment, the flange portions 14*m* and 14*n* are disposed so as to be point-symmetrical. The flange portions 14*m* and 14*n* in the following description will be collectively referred to as a "flange portion 14" in a case where it is not necessary to particularly distinguish the flange portions 14*m* and 14*n*.

It should be noted that the X-axis positive direction side is "inside" and the X-axis negative direction side is "outside" regarding the first flange portion 14*m* in the following description. In addition, regarding the second flange portion

14*n*, the X-axis negative direction side is "inside" and the X-axis positive direction side is "outside".

Figure 1B:
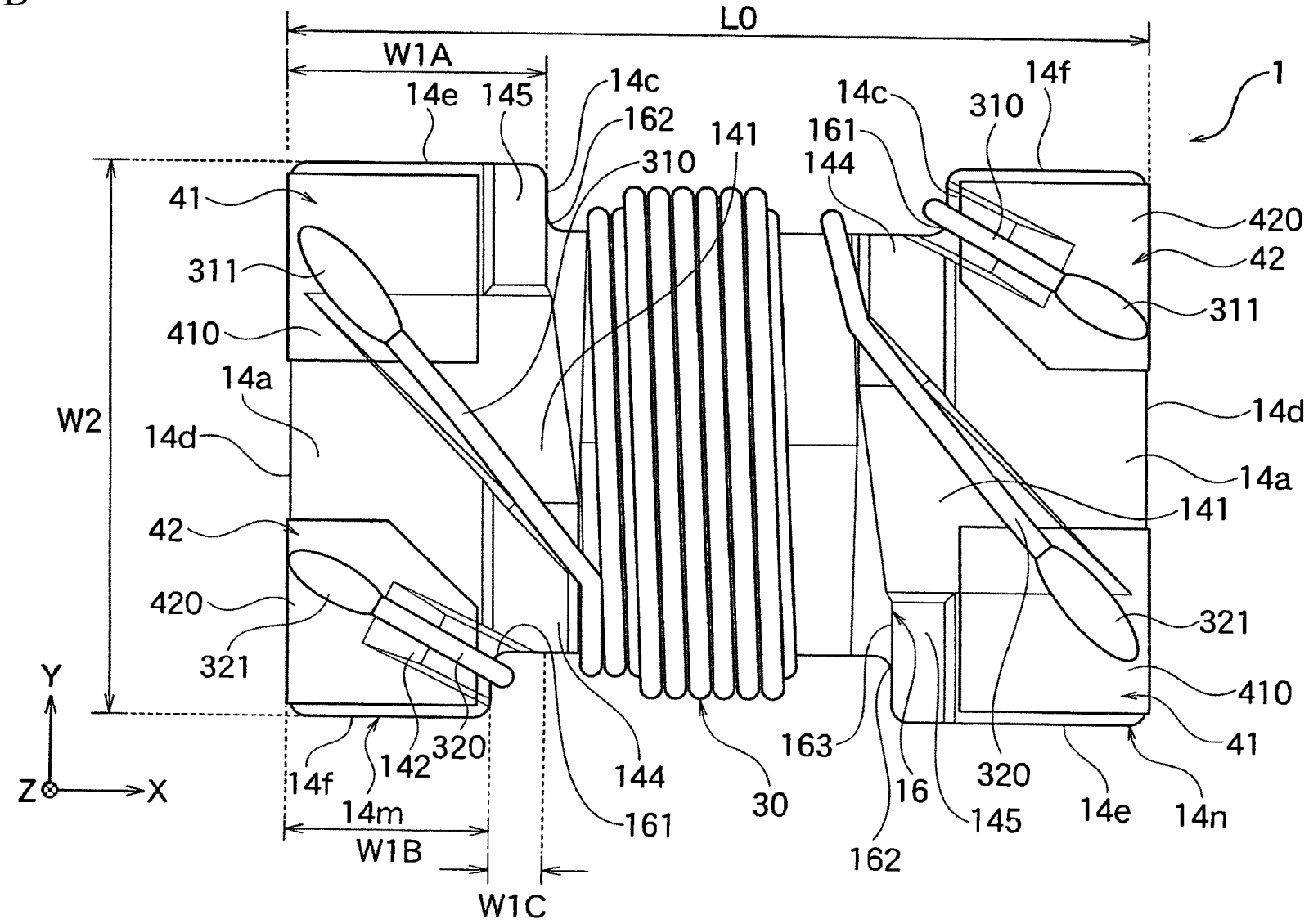
FIG. 1B is a plan view of the coil device illustrated in FIG. 1A.

Although the size of the drum core 10 (coil device 1) is not particularly limited, an X-axis-direction length L0 of the drum core 10 (coil device 1) is 1.46 to 1.86 mm, a Y-axis-direction width W2 of the drum core 10 (coil device 1) is 0.85 to 1.25 mm, and a Z-axis-direction height H1 (see FIG. 1C) is 0.45 to 0.53 mm as illustrated in FIG. 1B. The ratio W3/W2 of a Y-axis-direction width W3 of the winding core portion 12 illustrated in FIG. 2A to the Y-axis-direction width W2 of the flange portions 14*m* and 14*n* illustrated in FIG. 1B is preferably 0.6 to 0.9. It should be noted that the height H1 in FIG. 1C does not include a height H2 of a main protuberance 144 (described later) and a sub protuberance 145 (described later).

The winding core portion 12 has the winding axis in the X-axis direction and has an elongated and substantially hexagonal cross section in the Y-axis direction. Although the cross-sectional shape of the winding core portion 12 is substantially hexagonal in the present embodiment, the cross-sectional shape may be rectangular, circular, or substantially octagonal and the cross-sectional shape of the winding core portion 12 is not particularly limited. A part of the outer peripheral surface that is positioned in the substantially central portion of the winding core portion 12 in the Y-axis direction protrudes outward in a convex shape. As a result, the cross-sectional area of the winding core portion 12 can be ensured by the amount of the protrusion and the inductance characteristics of the coil device 1 can be improved. In the following description, the outer peripheral surface that is positioned on the upper side of the winding core portion 12 will be referred to as an upper surface, the outer peripheral surface that is positioned on the lower side of the winding core portion 12 will be referred to as a lower surface, and the outer peripheral surface that is positioned on the lateral side of the winding core portion 12 will be referred to as a side surface.

As illustrated in FIG. 1A, a first wire 31 and a second wire 32 are wound around the winding core portion 12 and the coil portion 30 is configured by the wires 31 and 32 being wound in one or more layers (two layers in the present embodiment). The wires 31 and 32 are made of, for example, coated conducting wires and have a configuration in which a core material made of a good conductor is covered with an insulating coating film Although the cross-sectional areas of the conductor parts of the wires 31 and 32 are the same in the present embodiment, the areas may be different from each other. In addition, the coil portion 30 may be configured by one wire being wound in one or more layers or may be configured by three or more wires being wound in one or more layers.

Although the numbers of windings of the wires 31 and 32 are substantially the same in the present embodiment, the numbers may be different from each other depending on the application. It should be noted that the numbers of windings of the wires 31 and 32 being substantially the same means that the ratio between the numbers of windings is within the range of 0.75 to 1/0.75 and preferably 1.

The outer shape of the flange portion 14 is a substantially rectangular parallelepiped shape (substantially rectangular shape) that is long in the Y-axis direction. The flange portions 14*m* and 14*n* are disposed so as to be substantially parallel to each other at a predetermined interval in the X-axis direction. As illustrated in FIG. 1B, the flange portion 14 is formed such that the four corners of the flange portion 14 are rounded when the flange portion 14 is viewed from the mounting surface side (Z-axis upper side in the present embodiment). It should be noted that the cross-sectional (YZ cross-sectional) shape of the flange portion 14 may be circular or substantially octagonal and the cross-sectional shape is not particularly limited.

The flange portion 14 has an upper surface (first surface) 14*a*, a lower surface (second surface) 14*b*, an inner end surface 14*c*, an outer end surface 14*d*, a first lateral side surface 14*e*, and a second lateral side surface 14*f*. The upper surface 14*a* is positioned on the upper side of the flange portion 14. The lower surface 14*b* is positioned on the side that is opposite to the upper surface 14*a* in the Z-axis direction. The inner end surface 14*c* is positioned on the winding core portion 12 side. The outer end surface 14*d* is positioned on the side that is opposite to the inner end surface 14*c* in the X-axis direction. The first lateral side surface 14*e* is a surface that is orthogonal to the upper surface 14*a* and the inner end surface 14*c* and is on the side where a first terminal electrode 41 (described later) is positioned. The second lateral side surface 14*f* is a surface that is orthogonal to the upper surface 14*a* and the inner end surface 14*c* and is on the side where a second terminal electrode 42 (described later) is positioned.

In the present embodiment, the upper surface 14*a* is a mounting surface (ground surface) in a case where the coil device 1 is mounted onto a circuit substrate or the like. It should be noted that there may be a Y-axis-direction deviation between the lateral side surfaces 14*e* and 14*f* although the second lateral side surface 14*f* of the first flange portion 14*m* and the first lateral side surface 14*e* of the second flange portion 14*n* are flush with each other in the illustrated example.

Figure 2A:
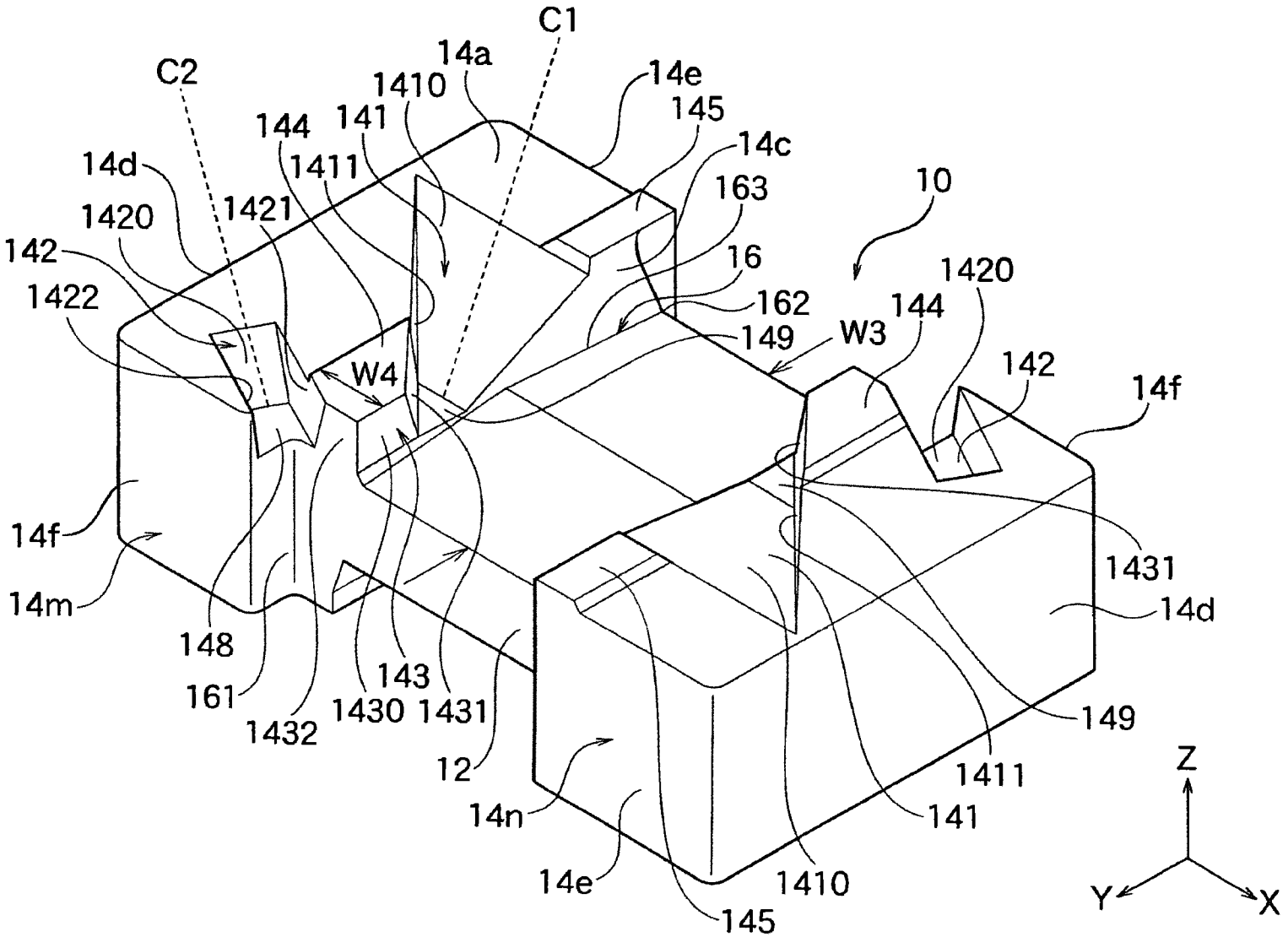
FIG. 2A is a perspective view illustrating a process of manufacturing the coil device illustrated in FIG. 1A.

As illustrated in FIG. 2A, a concave corner portion 16 is formed at the position where the winding core portion 12 and the flange portion 14 intersect with each other. The concave corner portion 16 is an angular part formed by the outer peripheral surface of the winding core portion 12 and the inner end surface 14*c* of the flange portion 14 and is formed so as to go around the circumference of the winding core portion 12 along the outer peripheral direction of the winding core portion 12. In the following description, the concave corner portion 16 that is formed by the inner end surface 14*c* of the flange portion 14 and the side surface of the winding core portion 12 (side surface positioned on the second lateral side surface 14*f* side) will be referred to as a first concave corner portion 161, the concave corner portion 16 that is positioned on the side opposite to the first concave corner portion 161 in the Y-axis direction across the winding core portion 12 will be referred to as a second concave corner portion 162, and the concave corner portion 16 that is formed by the upper surface of the winding core portion 12 and the inner end surface 14*c* of the flange portion 14 will be referred to as a third concave corner portion 163.

The first concave corner portion 161 is positioned on the side (lateral side of the winding core portion 12) where a first leadout portion 310 or a second leadout portion 320 (see FIG. 1A, described later) is separated from the winding core portion 12. The second concave corner portion 162 corresponds to the concave corner portion that is formed by the inner end surface 14*c* of the flange portion 14 and the side surface of the winding core portion 12 (side surface positioned on the first lateral side surface 14*e* side).

The first concave corner portion 161 and the second concave corner portion 162 constitute the side portion of the concave corner portion 16 and are formed along the Z-axis direction (height direction of the flange portion 14). The third concave corner portion 163 constitutes the upper portion of the concave corner portion 16 and is formed along the Y-axis direction.

In the present embodiment, the width of the upper surface 14*a* of the flange portion 14 along the X-axis direction is different between one end side and the other end side of the flange portion 14 in the Y-axis direction. In other words, as illustrated in FIG. 1B, a width W1B of the other end side of the upper surface 14*a* along the X-axis direction is smaller than a width W1A of one end side of the upper surface 14*a* along the X-axis direction (W1B<W1A) when W1A is the X-axis-direction width of one end side of the upper surface 14*a* where the first terminal electrode 41 (described later) is positioned and W1B is the X-axis-direction width of the other end side of the upper surface 14*a* where the second terminal electrode 42 (described later) is positioned.

It should be noted that the width W1A of one Y-axis-direction end side of the upper surface 14*a* along the X-axis direction corresponds to the length between the outer end surface 14*d* of the flange portion 14 and the inner end surface 14*c* positioned on one end side of the flange portion 14 in the Y-axis direction. In addition, the width W1B of the other Y-axis-direction end side of the flange portion 14 along the X-axis direction corresponds to the length between the outer end surface 14*d* of the flange portion 14 and the inner end surface 14*c* positioned on the other end side of the flange portion 14 in the Y-axis direction.

The X-axis-direction width W1A of one Y-axis-direction end side of the upper surface 14*a* of the flange portion 14 is preferably 0.45 cm to 0.51 cm. The X-axis-direction width W1B of the other Y-axis-direction end side of the upper surface 14*a* of the flange portion 14 is smaller than the width W1A and is preferably 0.26 cm to 0.36 cm. The ratio W1B/W1A between the width W1B and the width W1A is preferably 0.5 or more and less than 1 and more preferably 0.7 or more and less than 0.9. When the diameter of the first wire 31 or the second wire 32 is d, the size of a width W1C, which is the difference between the width W1A and the width W1B, is preferably equal to or greater than d and is more preferably equal to or greater than 2 d.

W1A exceeds W1B in the present embodiment, and thus a part of the inner end surface 14*c* positioned on the other end side of the flange portion 14 in the Y-axis direction is disposed so as to positionally deviate to the outer end surface 14*d* side of the flange portion 14 along the X-axis direction as compared with a part of the inner end surface 14*c* positioned on one end side of the flange portion 14 in the Y-axis direction. The deviation width between a part of the inner end surface 14*c* positioned on the other end side of the flange portion 14 in the Y-axis direction and a part of the inner end surface 14*c* positioned on one end side of the flange portion 14 in the Y-axis direction corresponds to the width W1C, which is the difference between the widths W1A and W1B described above. Although the deviation width is twice to three times the diameter of the second wire 32 in the illustrated example, the deviation width may be equal to or greater than twice to three times the diameter of the second wire 32.

In addition, the first concave corner portion 161 positionally deviates to the outer end surface 14*d* side of the flange portion 14 along the X-axis direction as compared with the second concave corner portion 162. The deviation width between the first concave corner portion 161 and the second concave corner portion 162 corresponds to the width W1C, which is the difference between the widths W1A and W1B described above.

Figure 4:
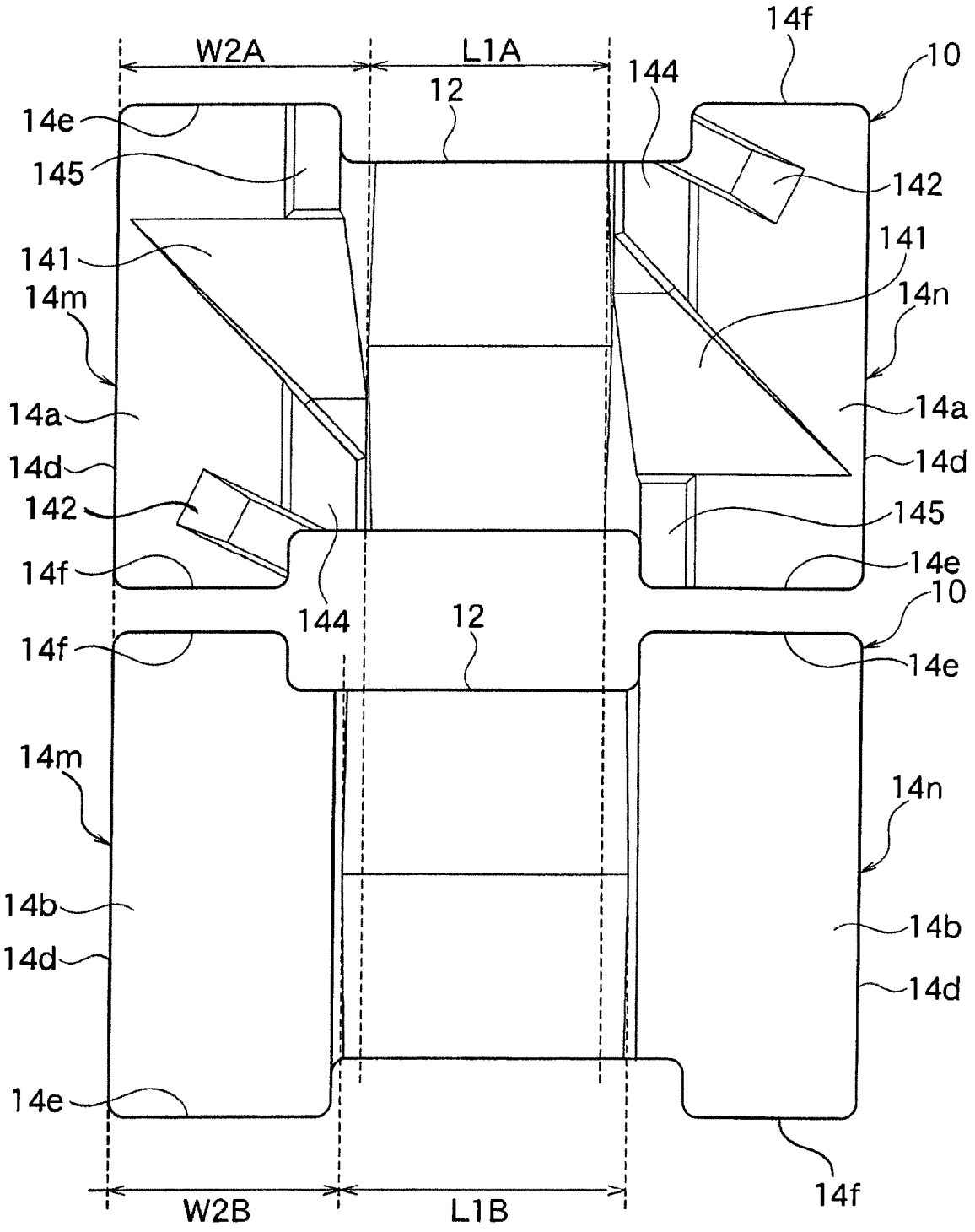
FIG. 4 is a diagram for describing the difference at a time when the core of the coil device illustrated in FIG. 1A is viewed from above and below.

As illustrated in FIG. 4, in the present embodiment, a width (maximum width) W2A of the upper surface 14*a* side of the flange portion 14 along the X-axis direction is different from a width (maximum width) W2B of the lower surface 14*b* side of the flange portion 14 along the X-axis direction. More specifically, the width W2A is larger than the width W2B. The difference W2A-W2B between the width W2A and the width W2B is preferably equal to or greater than d and is more preferably equal to or greater than 2 d. Here, d is the diameter of the first wire 31 or the second wire 32.

In addition, corresponding to the relationship between the widths W2A and W2B, a length L1A of the upper surface side of the winding core portion 12 along the X-axis direction and a length L1B of the lower surface side of the winding core portion 12 along the X-axis direction are different from each other. More specifically, the length L1A is smaller than the length L1B. The difference L1B-L1A between the length L1B and the length L1A is preferably equal to or greater than d and is more preferably equal to or greater than 2 d.

Figure 1C:
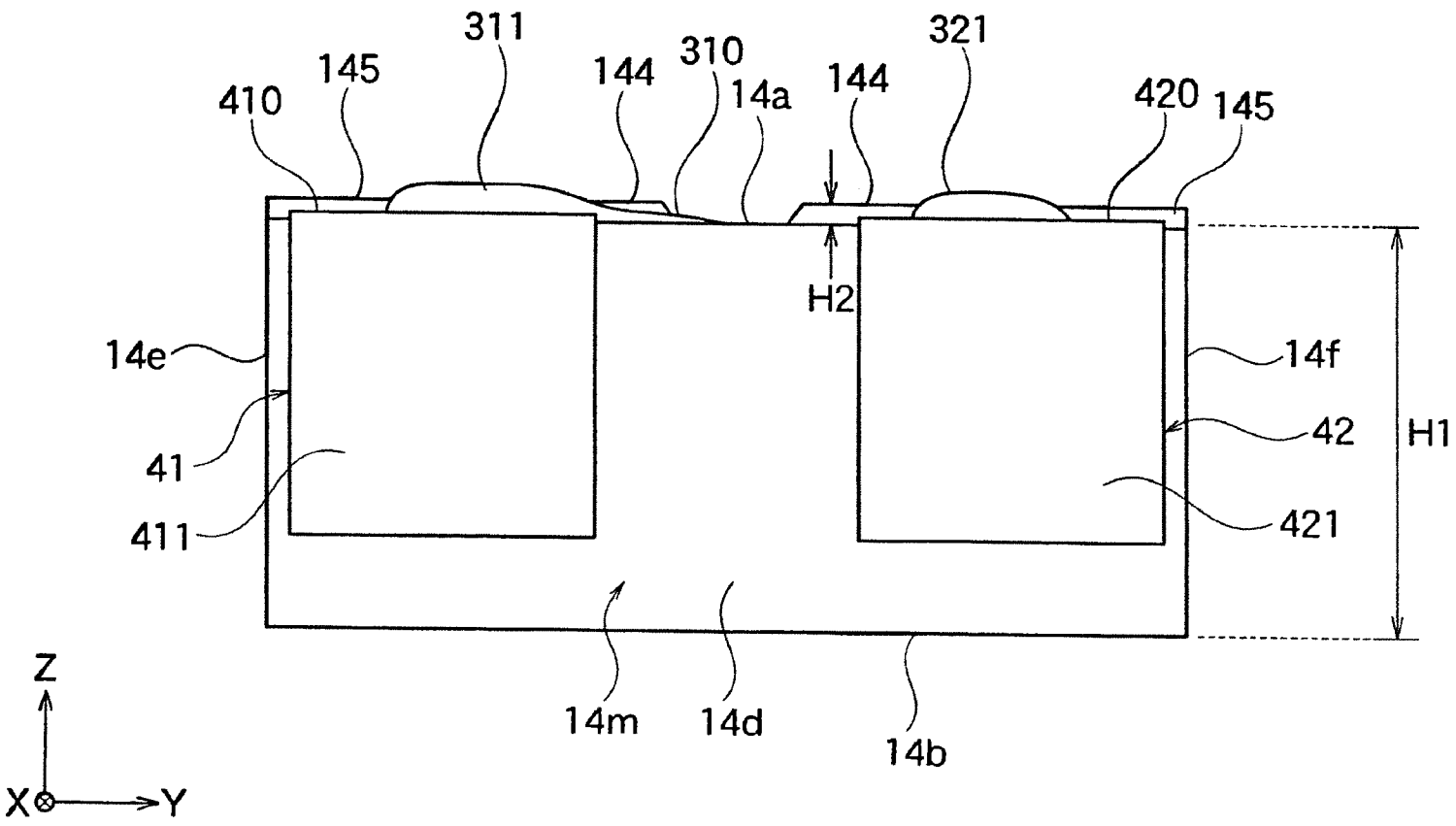
FIG. 1C is a side view in which the coil device illustrated in FIG. 1A is viewed from the IC direction.

As illustrated in FIGS. 1B and 1C, the first terminal electrode 41 is formed on the upper surface 14*a* (mounting surface) of the flange portion 14. The first terminal electrode 41 that is formed in the first flange portion 14*m* and the first terminal electrode 41 that is formed in the second flange portion 14*n* are similar in configuration to each other. The first terminal electrode 41 includes a first upper surface electrode portion 410 and a first side surface electrode portion 411, which are electrically connected. More specifically, the first upper surface electrode portion 410 has a surface parallel to the XY plane and is formed at one end of the upper surface 14*a* of the flange portion 14 in the Y-axis direction. A part of the first upper surface electrode portion 410 is formed so as to enter a first inclined portion 141 (described later). In addition, the first side surface electrode portion 411 has a surface parallel to the YZ plane and is formed on the end surface 14*d* of the flange portion 14. By forming the first side surface electrode portion 411 in the flange portion 14, it is possible to form a sufficient solder fillet for the first terminal electrode 41.

A first wire connection portion 311, which is a connection part for the first leadout portion 310 of the first wire 31, is formed in the first upper surface electrode portion 410 formed in the first flange portion 14*m*. A second wire connection portion 321, which is a connection part for the second leadout portion 320 of the second wire 32, is formed in the first upper surface electrode portion 410 formed in the second flange portion 14*n*. The wire connection portions 311 and 321 are formed by thermocompression bonding of the leadout portions 310 and 320 to the first upper surface electrode portion 410. In the present embodiment, the first upper surface electrode portion 410 also has a function as a mounting portion that faces and is connected to the surface of a circuit substrate (not illustrated). More specifically, the part of the first upper surface electrode portion 410 where the wire connection portions 311 and 321 are not formed functions as a good bonding surface for soldering to an electrode (land) of the circuit substrate.

It should be noted that solder wettability declines at thermocompression-bonded parts in general. Accordingly, it is preferable that the wire connection portions 311 and 321 are disposed not at the center of the first upper surface electrode portion 410 but in the end portions of the first upper surface electrode portion 410. In the present embodiment, the wire connection portions 311 and 321 are disposed in the vicinity of the outer end surface 14*d* of the flange portion 14. As a result, it is possible to ensure a sufficiently large area for the part of the first upper surface electrode portion 410 that is excellent in solder wettability and increase the bonding strength (adhesion strength) between the coil device and the circuit substrate. In addition, it is possible to sufficiently ensure the strength of adhesion to the circuit substrate even in a case where the coil device 1 is reduced in size.

The second terminal electrode 42 is formed on the upper surface 14*a* of the flange portion 14 at a predetermined interval (so as to be separated) from the first terminal electrode 41 along the Y-axis direction. The second terminal electrode 42 that is formed in the first flange portion 14*m* and the second terminal electrode 42 that is formed in the second flange portion 14*n* are similar in configuration to each other. It should be noted that the interval between the first terminal electrode 41 and the second terminal electrode 42 is not particularly limited insofar as the interval is a distance ensuring insulation.

In the present embodiment, the second terminal electrode 42 includes a second upper surface electrode portion 420 and a second side surface electrode portion 421, which are electrically connected. More specifically, the second upper surface electrode portion 420 has a surface parallel to the XY plane and is formed at the other Y-axis-direction end of the upper surface 14*a* of the flange portion 14 (on the side opposite to the first upper surface electrode portion 410 in the Y-axis direction). A part of the second upper surface electrode portion 420 is formed so as to enter a second inclined portion 142 (described later). In addition, the second side surface electrode portion 421 has a surface parallel to the YZ plane and is formed on the end surface 14*d* of the flange portion 14. By forming the second side surface electrode portion 421 in the flange portion 14, it is possible to form a sufficient solder fillet for the second terminal electrode 42.

The second wire connection portion 321, which is a connection part for the second leadout portion 320 of the second wire 32, is formed in the second upper surface electrode portion 420 formed in the first flange portion 14*m*. The first wire connection portion 311, which is a connection part for the first leadout portion 310 of the first wire 31, is formed in the second upper surface electrode portion 420 formed in the second flange portion 14*n*. The wire connection portions 311 and 321 are formed by thermocompression bonding of the leadout portions 310 and 320 to the second upper surface electrode portion 420. In the present embodiment, the second upper surface electrode portion 420 also has a function as a mounting portion that faces and is connected to the surface of the circuit substrate (not illustrated). More specifically, the part of the second upper surface electrode portion 420 where the wire connection portions 311 and 321 are not formed functions as a good bonding surface for soldering to the electrode (land) of the circuit substrate.

It should be noted that it is preferable that the wire connection portions 311 and 321 are disposed not at the center of the second upper surface electrode portion 420 but in the end portions of the second upper surface electrode portion 420. In the present embodiment, the wire connection portions 311 and 321 are disposed in the vicinity of the outer end surface 14*d* of the flange portion 14. As a result, it is possible to ensure a sufficiently large area for the part of the second upper surface electrode portion 420 that is excellent in solder wettability and increase the adhesion strength between the coil device and the circuit substrate. In addition, it is possible to sufficiently ensure the strength of adhesion to the circuit substrate even in a case where the coil device 1 is reduced in size.

The first terminal electrode 41 and the second terminal electrode 42 are made of, for example, a metal paste baking film or a metal plating film The terminal electrodes 41 and 42 are formed by Ag paste or the like being applied to the surfaces of the upper surface 14*a* and the outer end surface 14*d* of the flange portion 14, baking being performed, and then electroplating, electroless plating, or the like being performed on the surfaces for a plating film to be formed.

It should be noted that the material of the metal paste is not particularly limited and Cu paste, Ag paste, and the like are exemplified. In addition, the plating film may be a single-layer plating film or a multi-layer plating film and examples of the plating film include Cu plating, Ni plating, Sn plating, Ni—Sn plating, Cu—Ni—Sn plating, Ni—Au plating, and Au plating. The thickness of the terminal electrodes 41 and 42 is not particularly limited and is preferably 0.1 to 15 μm.

As illustrated in FIG. 2A, the first inclined portion 141 and the second inclined portion 142 are formed in the flange portion 14. The first inclined portion 141 that is formed in the first flange portion 14*m* and the first inclined portion 141 that is formed on the second flange portion 14*n* are similar in configuration to each other. In addition, the second inclined portion 142 that is formed in the first flange portion 14*m* and the second inclined portion 142 that is formed in the second flange portion 14*n* are similar in configuration to each other. In the present embodiment, the respective inclined portions 141 and 142 formed in the first flange portion 14*m* and the respective inclined portions 141 and 142 formed in the second flange portion 14*n* are disposed so as to be point-symmetrical.

The first inclined portion 141 is formed in the range between the upper surface of the winding core portion 12 and the upper surface 14*a* of the flange portion 14 and extends at an angle in the Z-axis direction with respect to the Y-axis direction. An extension line C1 of the central axis of the first inclined portion 141 intersects with the first lateral side surface 14*e* of the flange portion 14 and intersects with a peripheral edge portion 1490 of a step surface 149 (see FIG. 2B, described later).

The first inclined portion 141 has a first inclined surface 1410 and a first wall-side side surface 1411. The first inclined surface 1410 is an inclined surface inclined from one Y-axis-direction end side of the flange portion 14 toward the other Y-axis-direction end side of the flange portion 14. At the position of the first inclined portion 141, the inner end surface 14*c* of the flange portion 14 is cut out by the first inclined surface 1410.

Figure 2B:
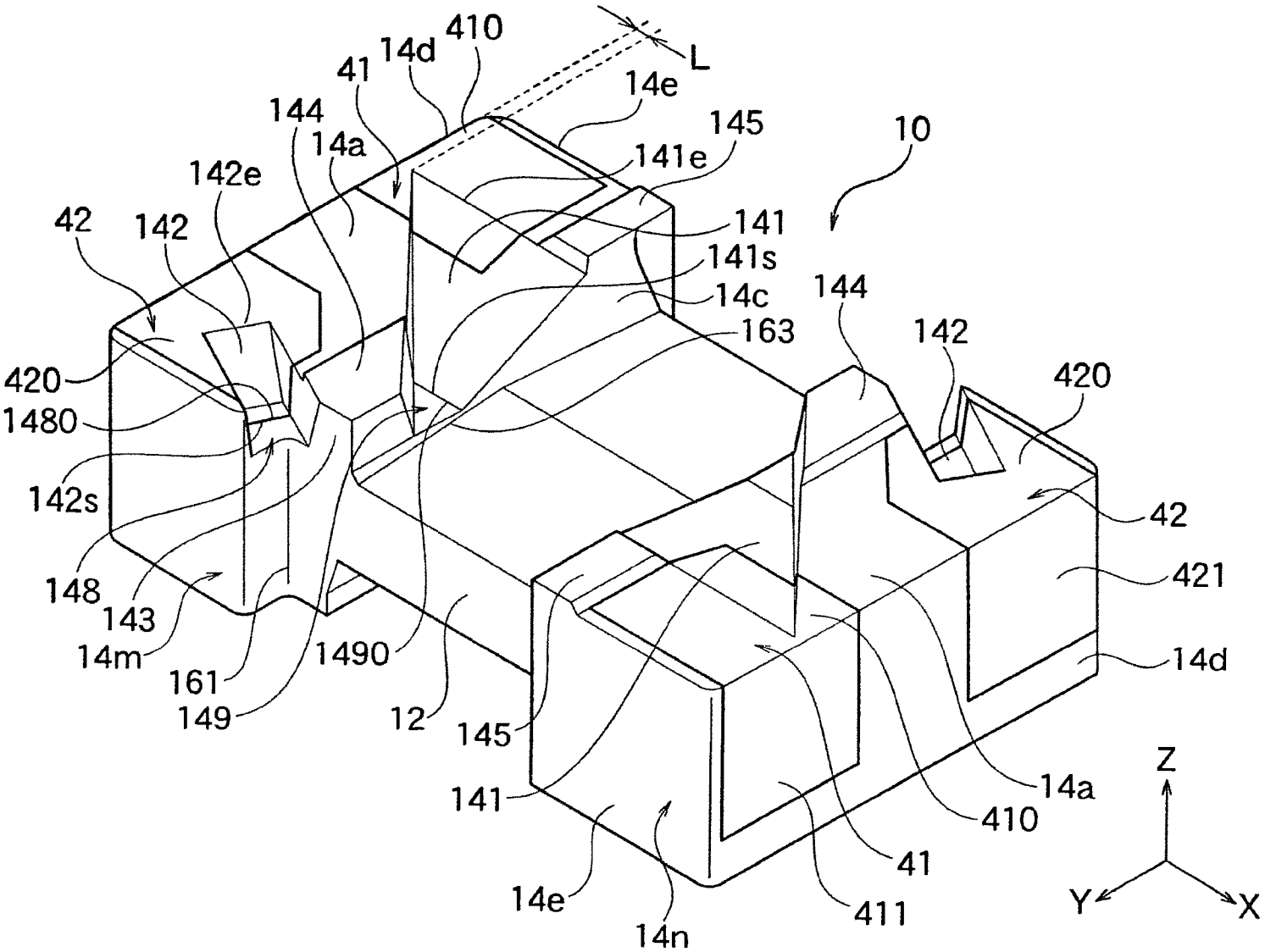
FIG. 2B is a perspective view illustrating a step that follows the step of FIG. 2A.

As illustrated in FIG. 2B, a starting end 141*s* of the first inclined portion 141 is positioned closer to the other end side in the Y-axis direction than the center of the flange portion 14 in the Y-axis direction and a terminal end 141*e* of the first inclined portion 141 is positioned closer to one end side in the Y-axis direction than the center of the flange portion 14 in the Y-axis direction.

The first inclined surface 1410 is formed so as to increase in width in the X-axis direction from the starting end 141*s* of the first inclined portion 141 toward the terminal end 141*e* and formed from the vicinity of the outer end surface 14*d* of the flange portion 14 to the inner end surface 14*c* of the flange portion 14 in the terminal end portion of the first inclined portion 141 (peripheral portion of the terminal end 141*e*). When the distance between the end portion of the first inclined surface 1410 in the X-axis direction and the outer end surface 14*d* of the flange portion 14 at the terminal end 141*e* of the first inclined surface 1410 is L, the ratio L/W1A of the distance L to the width W1A of one end side of the upper surface 14*a* of the flange portion 14 along the X-axis direction is preferably 0 to 0.2.

As illustrated in FIG. 2A, the first wall-side side surface 1411 constitutes a part of a wall portion 143. The first wall-side side surface 1411 is made of a rising wall surface and extends along the lateral side of the first inclined surface 1410.

The second inclined portion 142 obliquely extends toward the outside of the flange portion 14 (outer end surface 14*d*) at an angle different from that of the first inclined portion 141 and is inclined so as to gradually descend. An extension line C2 of the central axis of the second inclined portion 142 intersects with the outer end surface 14*d* of the flange portion 14, extends toward the first concave corner portion 161, and intersects with a peripheral edge portion 1480 of a step surface 148 (see FIG. 2B, described later). The angle that is formed by the extension line C2 and the X axis is preferably 18 to 24-. It should be noted that the direction of extension of the extension line C2 is substantially the same as the leadout direction of the second leadout portion 320 that is drawn out along the second inclined portion 142 (see FIG. 1A).

The second inclined portion 142 has a groove shape (groove portion) and has a second inclined surface 1420, a second wall-side side surface 1421, and a second outer-side side surface 1422. The second inclined surface 1420 is disposed so as to be sandwiched between the second wall-side side surface 1421 and the second outer-side side surface 1422 and made of an inclined surface inclined from the outer end surface 14*d* of the flange portion 14 toward the inner end surface 14*c*.

The second wall-side side surface 1421 is formed adjacent to the wall portion 143 and constitutes a part of the wall portion 143. The second outer-side side surface 1422 is formed on the side that is opposite to the second wall-side side surface 1421 across the second inclined surface 1420.

The step surface 148 and the step surface 149 are formed in the flange portion 14. The step surface 148 has a substantially planar shape and is formed on the other end side of the third concave corner portion 163 in the Y-axis direction (second lateral side surface 14*f* side) or near the upper end of the first concave corner portion 161.

As illustrated in FIG. 2B, in the present embodiment, a second starting end 142*s* of the second inclined portion 142 is connected to the peripheral edge portion 1480 of the step surface 148. The second starting end 142*s* of the second inclined portion 142 corresponds to the intersection of the step surface 148 and the second inclined portion 142 (second inclined surface 1420). A second terminal end 142*e* of the second inclined portion 142 corresponds to the intersection of the upper surface 14*a* of the flange portion 14 and the second inclined portion 142 (second inclined surface 1420).

The step surface 149 has a substantially planar shape and is formed adjacent to the third concave corner portion 163 and the wall portion 143 on the other end side as compared with the central portion of the flange portion 14 in the Y-axis direction. The first starting end 141*s* of the first inclined portion 141 is connected to the peripheral edge portion 1490 of the step surface 149. The first starting end 141*s* of the first inclined portion 141 corresponds to the intersection of the step surface 149 and the first inclined portion 141 (first inclined surface 1410). The first terminal end 141*e* of the first inclined portion 141 corresponds to the intersection of the upper surface 14*a* of the flange portion 14 and the first inclined portion 141 (first inclined surface 1410).

As illustrated in FIG. 1A, in the present embodiment, the first leadout portion 310 of the first wire 31 passes through the first inclined portion 141 of the first flange portion 14*m* and the second leadout portion 320 of the second wire 32 passes through the second inclined portion 142 of the first flange portion 14*m*. In addition, the second leadout portion 320 of the second wire 32 passes through the first inclined portion 141 of the second flange portion 14*n* and the first leadout portion 310 of the first wire 31 passes through the second inclined portion 142 of the second flange portion 14*n*.

More specifically, as illustrated in FIGS. 1A and 2A, the first leadout portion 310 of the first wire 31 on the first flange portion 14*m* side is drawn out toward the step surface 149 side after separation from the winding core portion 12 (or the coil portion 30) on the side surface side of the winding core portion 12. Then, the first leadout portion 310 passes over the step surface 149 without contact with the step surface 149 and is obliquely drawn out toward the first terminal electrode 41 along the first inclined surface 1410 of the first inclined portion 141 (see FIG. 2A). More specifically, the first leadout portion 310 is drawn out to the first terminal electrode 41 along the first wall-side side surface 1411 of the first inclined portion 141 or while being fixed to the first wall-side side surface 1411.

In addition, the second leadout portion 320 of the second wire 32 on the first flange portion 14*m* side is drawn out toward the step surface 148 side after separation from the winding core portion 12 (or the coil portion 30) on the side surface side of the winding core portion 12. Then, the second leadout portion 320 passes over the step surface 148 without contact with the step surface 148 and is obliquely drawn out along the second inclined surface 1420 of the second inclined portion 142, toward the second terminal electrode 42 (or the outer end surface 14*d* of the flange portion 14), and at an angle different from that of the first leadout portion 310.

In addition, the second leadout portion 320 of the second wire 32 on the second flange portion 14*n* side is drawn out toward the step surface 149 side after separation from the winding core portion 12 (or the coil portion 30) on the side surface side of the winding core portion 12. Then, the second leadout portion 320 passes over the step surface 149 without contact with the step surface 149 and is obliquely drawn out toward the first terminal electrode 41 along the first inclined surface 1410 of the first inclined portion 141 or while being fixed to the first wall-side side surface 1411.

In addition, the first leadout portion 310 of the first wire 31 on the second flange portion 14*n* side is drawn out toward the step surface 148 (not illustrated) side after separation from the winding core portion 12 (or the coil portion 30) on the side surface side of the winding core portion 12. Then, the first leadout portion 310 passes over the step surface 148 without contact with the step surface 148 and is obliquely drawn out along the second inclined surface 1420 of the second inclined portion 142, toward the second terminal electrode 42 (or the outer end surface 14*d* of the flange portion 14), and at an angle different from that of the second leadout portion 320.

As described above, in the present embodiment, the first concave corner portion 161 positionally deviates to the outer end surface 14*d* side of the flange portion 14 by the distance corresponding to the width W1C (see FIG. 1B) as compared with the second concave corner portion 162. Accordingly, the second leadout portion 320 can be obliquely drawn out in the range between the step surface 148 and the end portion of the winding core portion 12 on the X-axis negative direction side and each of the first leadout portion 310 and the second leadout portion 320 can be disposed separately along the X-axis direction in the vicinity of the first concave corner portion 161.

It should be noted that the second wire 32 may be aerially wired from the step surface 148 to the front of the second terminal end 142*e* of the second inclined portion 142 and abut against the bottom (second inclined surface 1420) of the second inclined portion 142 in the front of the second terminal end 142*e* of the second inclined portion 142.

The first inclined portion 141 and the second inclined portion 142 are separated from each other by the wall portion 143 formed in the flange portion 14. The wall portion 143 is positioned between the first inclined portion 141 and the second inclined portion 142. A part of the wall portion 143 protrudes inward in the X-axis direction as compared with the sub protuberance 145 (described later). Accordingly, the first leadout portion 310 is drawn out toward the first inclined portion 141 so as to bypass a part of the wall portion 143 protruding from the inner end surface 14*c* of the flange portion 14. Accordingly, it is possible to sufficiently separate each of the first leadout portion 310 and the second leadout portion 320 and effectively prevent contact between the first leadout portion 310 and the second leadout portion 320.

As illustrated in FIG. 2A, the wall portion 143 has a tip surface 1430, a first side surface 1431, and a second side surface 1432. The tip surface 1430 is made of a wall surface substantially parallel to the YZ plane and constitutes a part of the inner end surface 14*c* of the flange portion 14. The tip surface 1430 constitutes the tip part of the wall portion 143, and the first side surface 1431 and the second side surface 1432 are connected to both sides thereof The first side surface 1431 is made of a rising wall surface and is connected to the first wall-side side surface 1411 of the first inclined portion 141. Although the first side surface 1431 is continuously connected to the first wall-side side surface 1411, the first side surface 1431 may be discontinuously connected to the first wall-side side surface 1411. The second side surface 1432 is made of a wall surface substantially parallel to the XZ plane and is discontinuously connected to the second wall-side side surface 1421 of the second inclined portion of the flange portion 14.

In the present embodiment, the main protuberance 144 having a protuberating shape (convex shape or protruding shape) is formed on the upper surface (first surface) 14*a* of the flange portion 14. The main protuberance 144 is formed on the other end side of the flange portion 14 in the Y-axis direction and is positioned inside the region that is sandwiched between the first inclined portion 141 and the second inclined portion 142. More specifically, the main protuberance 144 is formed on the X-axis-direction inner side of the flange portion 14 in the region sandwiched between the first inclined portion 141 and the second inclined portion 142 and constitutes a part of the upper surface of the wall portion 143.

At the position where the main protuberance 144 is formed on the upper surface 14*a* of the flange portion 14, the height of the upper surface 14*a* of the flange portion 14 is higher than that around the position. The upper surface of the main protuberance 144 is a flat surface. On the upper surface 14*a* of the flange portion 14, a step is formed between the position where the main protuberance 144 is formed and the position where the main protuberance 144 is not formed (X-axis-direction outside end portion of the main protuberance 144).

As illustrated in FIG. 1C, the ratio H2/H1 of the height H2 of the main protuberance 144 (height from the peripheral portion of the main protuberance 144 on the upper surface 14*a* of the flange portion 14) to the height H1 of the flange portion 14 (height from the peripheral portion of the main protuberance 144 on the upper surface 14*a* of the flange portion 14) is preferably 0.01 to 0.08 and more preferably 0.03 to 0.06. In addition, the ratio H2/d of the height H2 of the main protuberance 144 to the above d is preferably 0.3 to 1.3 and more preferably 0.5 to 1.0. Here, d is the diameter of the first wire 31 or the second wire 32. It should be noted that the upper surface of the main protuberance 144 may be formed so as to rise in, for example, a mountain shape although the upper surface of the main protuberance 144 is a flat surface in the illustrated example.

In FIG. 1C, the height H2 of the main protuberance 144 is a height at which a part of the second wire connection portion 321 of the second leadout portion 320 protrudes upward beyond the upper surface of the main protuberance 144 when the second leadout portion 320 of the second wire 32 is connected to the second upper surface electrode portion 420 of the second terminal electrode 42.

As illustrated in FIG. 2A, the main protuberance 144 constitutes a part of the wall portion 143 and is configured by the upper surface of the wall portion 143 being extended upward. The side surface of the main protuberance 144 is configured by the first wall-side side surface 1411 of the first inclined portion 141, the second wall-side side surface 1421 of the second inclined portion 142, and the tip surface 1430, the first side surface 1431, and the second side surface 1432 of the wall portion 143. Although the upper surface of the main protuberance 144 is connected discontinuously (in a stepped shape) to the peripheral portion thereof, the upper surface of the main protuberance 144 may be continuously connected thereto.

As illustrated in FIG. 2A, the main protuberance 144 is polygonal (pentagonal in the illustrated example) when viewed from above in the Z-axis direction and is formed so as to increase in width toward the outside in the X-axis direction. The ratio W4/W1A of a maximum width W4 of the main protuberance 144 in the X-axis direction to the width W1A (see FIG. 1B) of one end side of the upper surface 14*a* of the flange portion 14 along the X-axis direction is preferably 0.2 to 0.5 and more preferably 0.3 to 0.4.

As illustrated in FIG. 2B, in the present embodiment, the X-axis-direction inside end portion of the second upper surface electrode portion 420 of the second terminal electrode 42 is positioned outside the X-axis-direction outside end portion of the main protuberance 144 and the second upper surface electrode portion 420 and the main protuberance 144 are disposed side by side along the X-axis direction. In other words, the second upper surface electrode portion 420 is not formed at the main protuberance 144 and each of the main protuberance 144 and the second upper surface electrode portion 420 is disposed independently (without overlapping). In addition, the main protuberance 144 is locally disposed at the position that corresponds to the second upper surface electrode portion 420 of the second terminal electrode 42.

As illustrated in FIG. 1A, the second leadout portion 320 of the second wire 32 is connected to the second upper surface electrode portion 420 of the second terminal electrode 42 outside the main protuberance 144 in the X-axis direction and the second wire connection portion 321 is formed at the position. Accordingly, the main protuberance 144 is disposed between the second wire connection portion 321 and the coil portion 30.

The main protuberance 144 is positioned inside the region that is sandwiched between the first leadout portion 310 of the first wire 31 drawn out along the first inclined portion 141 and the second leadout portion 320 of the second wire 32 drawn out along the second inclined portion 142. The main protuberance 144 has a predetermined width in the Y-axis direction (approximately ¼ to ⅓ of the Y-axis-direction width of the flange portion 14 in the illustrated example). As a result, it is possible to sufficiently separate the first leadout portion 310 and the second leadout portion 320 that pass around the main protuberance 144 and prevent contact between the first leadout portion 310 and the second leadout portion 320.

As illustrated in FIG. 2A, the sub protuberance 145 as well as the main protuberance 144 is formed on the upper surface 14*a* of the flange portion 14. The sub protuberance 145 has a protuberating shape (convex shape or protruding shape). The sub protuberance 145 is formed on one end side of the flange portion 14 in the Y-axis direction and is positioned on the X-axis-direction inner side of the flange portion 14. The sub protuberance 145 is positioned closer to one end side in the Y-axis direction than the first inclined portion 141. The first inclined portion 141 is sandwiched between the main protuberance 144 and the sub protuberance 145.

At the position where the sub protuberance 145 is formed on the upper surface 14*a* of the flange portion 14, the height of the upper surface 14*a* of the flange portion 14 is higher than that around the position. The upper surface of the sub protuberance 145 is a flat surface. On the upper surface 14*a* of the flange portion 14, a step is formed between the position where the sub protuberance 145 is formed and the position where the sub protuberance 145 is not formed (X-axis-direction outside end portion of the sub protuberance 145). The height of the sub protuberance 145 and the height H2 of the main protuberance 144 (see FIG. 1C) are substantially equal to each other. It should be noted that the upper surface of the sub protuberance 145 may be formed so as to rise in, for example, a mountain shape although the upper surface of the sub protuberance 145 is a flat surface in the illustrated example.

Although the sub protuberance 145 is polygonal (rectangular in the illustrated example) when viewed from above in the Z-axis direction, the shape is not particularly limited.

As illustrated in FIG. 2B, the X-axis-direction inside end portion of the first upper surface electrode portion 410 is positioned outside the X-axis-direction outside end portion of the sub protuberance 145 and the first upper surface electrode portion 410 and the sub protuberance 145 are disposed side by side along the X-axis direction. In other words, the first upper surface electrode portion 410 of the first terminal electrode 41 is not formed at the sub protuberance 145 and each of the sub protuberance 145 and the first upper surface electrode portion 410 is disposed independently (without overlapping).

As illustrated in FIG. 1A, the first leadout portion 310 of the first wire 31 is connected to the first upper surface electrode portion 410 of the first terminal electrode 41 outside the sub protuberance 145 in the X-axis direction and the first wire connection portion 311 is formed at the position. Accordingly, the sub protuberance 145 is disposed between the first wire connection portion 311 and the coil portion 30.

Figure 5:
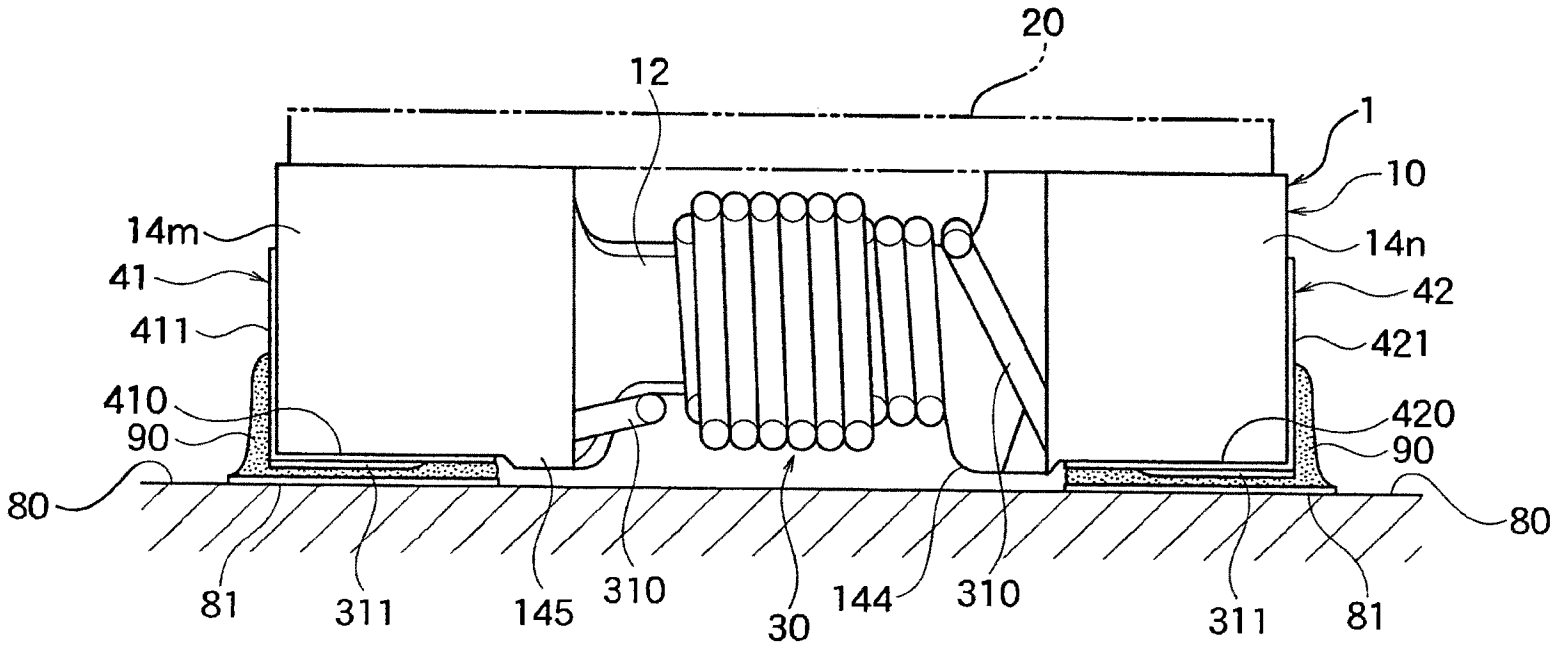
FIG. 5 is a side view when the coil device illustrated in FIG. 1A is mounted on a mounting substrate.

As illustrated in FIG. 5, the coil device 1 is fixed to a mounting substrate 80 via a connection member 90 such as solder and a conductive adhesive. More specifically, on the first flange portion 14*m* side, the first upper surface electrode portion 410 of the first terminal electrode 41 is connected to a land 81 of the mounting substrate 80 via the connection member 90 outside the sub protuberance 145 in the X-axis direction. In addition, although not illustrated in detail, the second upper surface electrode portion 420 of the second terminal electrode 42 is connected to the land 81 of the mounting substrate 80 via the connection member 90 outside the main protuberance 144 in the X-axis direction.

On the second flange portion 14*n* side, the second upper surface electrode portion 420 of the second terminal electrode 42 is connected to the land 81 of the mounting substrate 80 via the connection member 90 outside the main protuberance 144 in the Z-axis direction. In addition, although not illustrated in detail, the first upper surface electrode portion 410 of the first terminal electrode 41 is connected to the land 81 of the mounting substrate 80 via the connection member 90 outside the sub protuberance 145 in the X-axis direction.

When the upper surface electrode portions 410 and 420 of the terminal electrodes 41 and 42 are connected to the land 81 of the mounting substrate 80, the upper surface of each of the main protuberance 144 and the sub protuberance 145 is disposed at a position separated upward by a predetermined distance from the mounting substrate 80 without contact with the mounting substrate 80. It should be noted that the land 81 of the mounting substrate 80 is preferably formed in the shape of the upper surface electrode portions 410 and 420 of the terminal electrodes 41 and 42.

The drum-type drum core 10 and the wires 31 and 32 are prepared first when the coil device 1 is manufactured. It should be noted that a core material made of a good conductor such as copper (Cu) and covered with an insulating material made of imide-modified polyurethane or the like can be used as the wires 31 and 32 with the outermost surface of the core material covered with a thin resin film such as polyester.

Examples of the magnetic material that constitutes the drum core 10 include a metallic magnetic material and a magnetic material having a relatively high magnetic permeability such as Ni—Zn-based ferrite and Mn—Zn-based ferrite. The drum core 10 is manufactured by powder of the magnetic materials being molded and sintered. As illustrated in FIG. 2A, the drum core 10 at that time is manufactured such that the first inclined portion 141, the second inclined portion 142, the main protuberance 144, and the sub protuberance 145 are formed in respective portions of the flange portion 14. In addition, the drum core 10 is manufactured such that the winding core portion 12 and the pair of flange portions 14 are integrally molded and the width of the flange portion 14 along the X-axis direction is different between one end side and the other end side of the flange portion 14 in the Y-axis direction.

Next, metal paste is applied to the flange portion 14 of the drum core 10 and baking is performed at a predetermined temperature. Then, electroplating or electroless plating is performed on the surface thereof As a result, the first terminal electrode 41 and the second terminal electrode 42 as illustrated in FIG. 2B are formed.

Figure 2C:
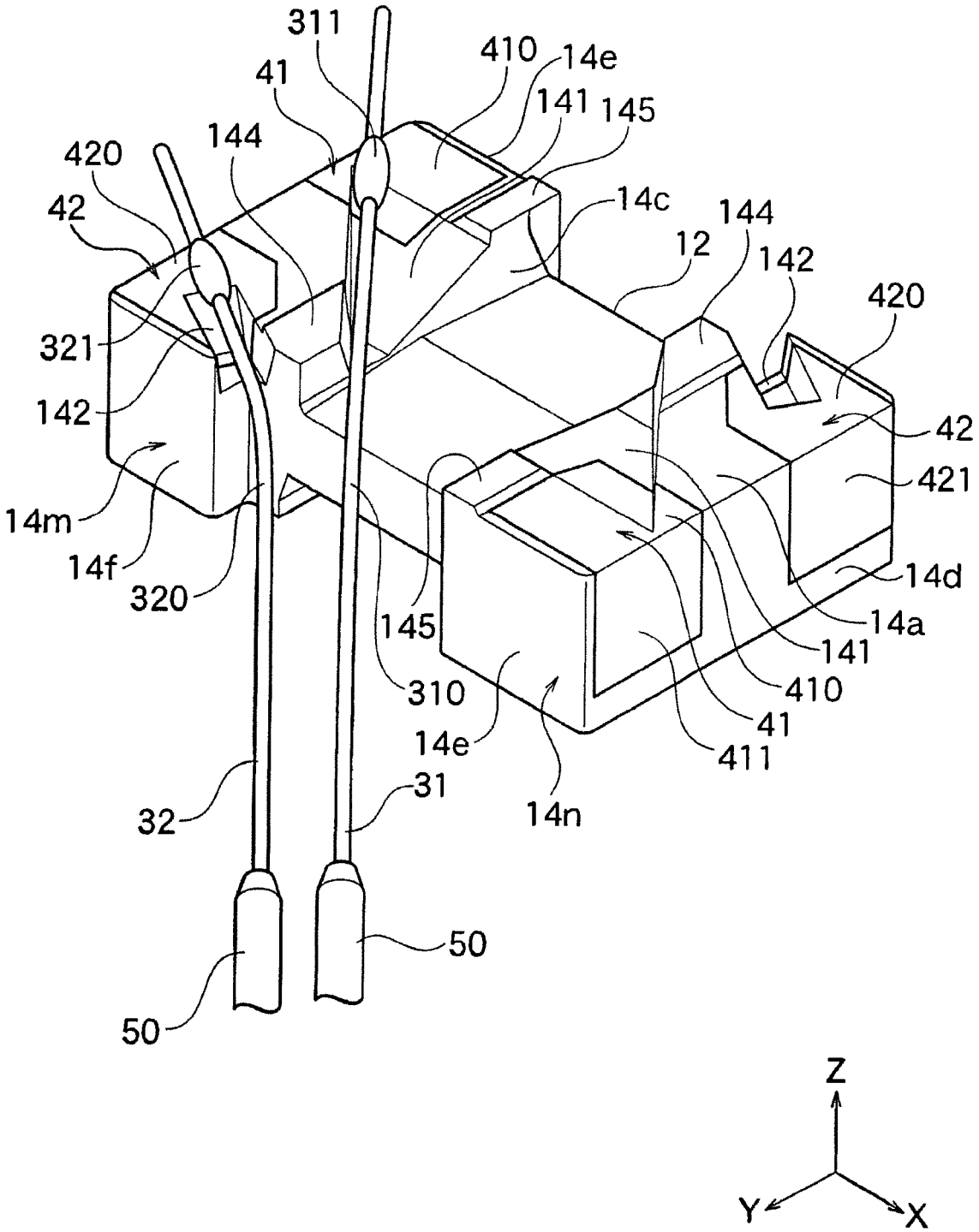
FIG. 2C is a perspective view illustrating a step that follows the step of FIG. 2B.

Next, the wires 31 and 32 and the drum core 10 where the terminal electrodes 41 and 42 are formed are set in a winding machine (not illustrated). Then, as illustrated in FIG. 2C, the first wire 31 (first leadout portion 310) is drawn out from the tip of a nozzle 50 and connected to the first upper surface electrode portion 410 of the first terminal electrode 41. As a result, the first wire connection portion 311 is formed at the connection part between the first upper surface electrode portion 410 and the first wire 31.

At the same time (or subsequently), the second wire 32 (second leadout portion 320) is drawn out from the tip of the nozzle 50 and connected to the second upper surface electrode portion 420 of the second terminal electrode 42. As a result, the second wire connection portion 321 is formed at the connection part between the second upper surface electrode portion 420 and the second wire 32.

It should be noted that methods for the connection are not particularly limited and, for example, a heater chip is pressed so as to sandwich the wires 31 and 32 between the terminal electrodes 41 and 42 and the wires 31 and 32 are thermocompression-bonded to the terminal electrodes 41 and 42. It should be noted that the insulating material with which the core wires of the wires 31 and 32 are coated is melted by the heat during the thermocompression bonding and thus there is no need to perform film removal on the wires 31 and 32.

In the present embodiment, each of the wires 31 and 32 is thermocompression-bonded to the terminal electrodes 41 and 42 at a position equidistant from the outer end surface 14*d* in the vicinity of the outer end surface 14*d* of the flange portion 14. By aligning the position of thermocompression bonding with regard to each of the wires 31 and 32 as described above, it is possible to thermocompression-bond each of the wires 31 and 32 to the terminal electrodes 41 and 42 at one time under appropriate fusion bonding conditions and without heater chip replacement or preparation of heater chips. Accordingly, the reliability and workability of the thermocompression bonding can be enhanced.

Figure 2D:
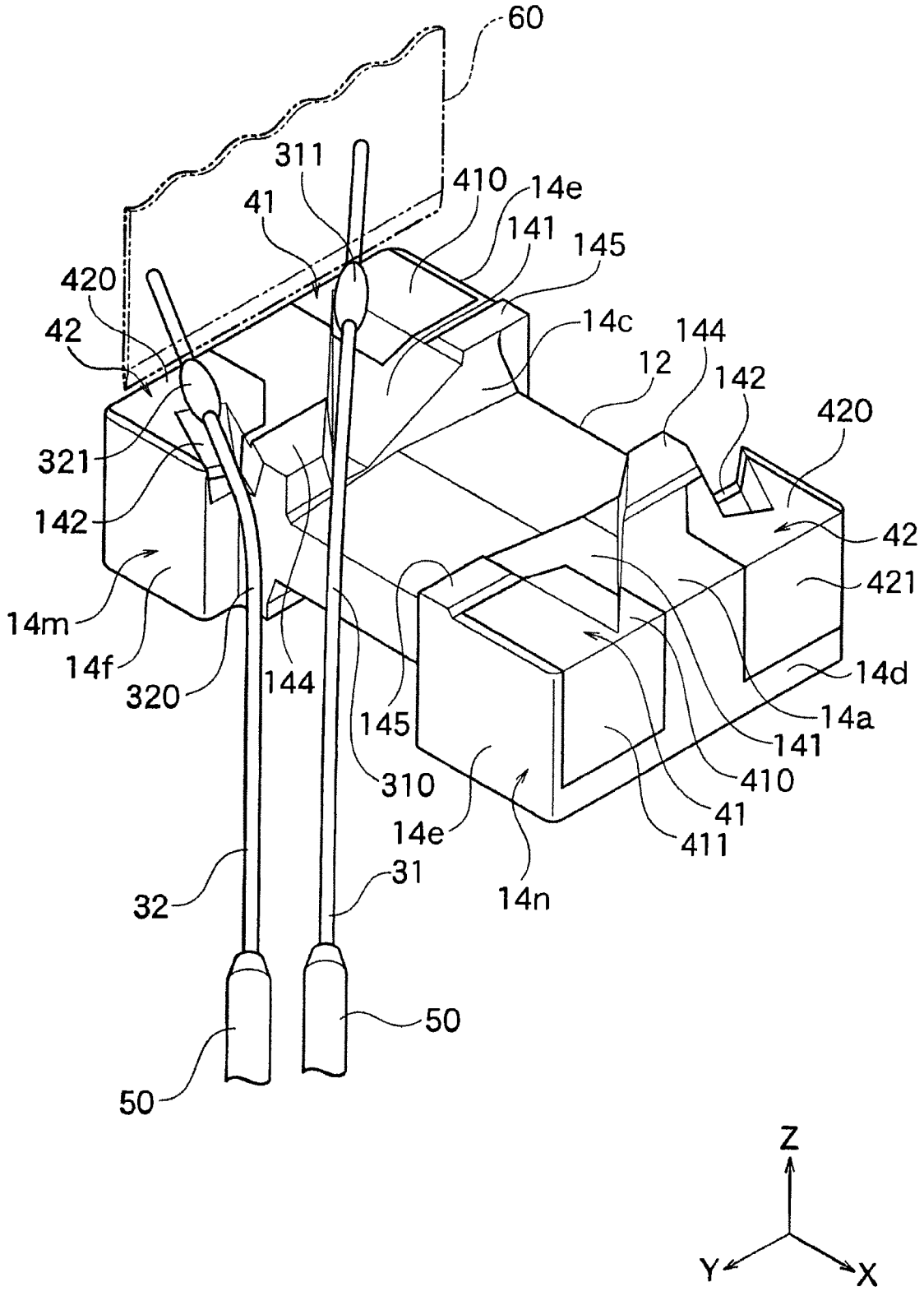

Next, as illustrated in FIG. 2D, unnecessary parts of the wires 31 and 32 (leadout portions 310 and 320) protruding from the upper surface electrode portions 410 and 420 (terminal electrodes 41 and 42) are cut by means of a cutting tool 60. During the cutting of the unnecessary parts of the leadout portions 310 and 320, the cutting points of the leadout portions 310 and 320 are disposed in the peripheral portion of the outer end surface 14*d* of the flange portion 14 and the cutting tool 60 is disposed (positioned) such that the side surface of the cutting tool 60 is substantially flush with the outer end surface 14*d*.

Then, at that position, the cutting tool 60 is lowered in the Z-axis direction along the outer end surface 14*d*. As a result, it is possible to cut the cutting points of the leadout portions 310 and 320 without contact of the cutting tool 60 with the corner portion of the upper surface 14*a* of the flange portion 14 and the outer end surface 14*d* and prevent damage to the flange portion 14.

In the present embodiment, each of the leadout portions 310 and 320 is drawn out toward the outer end surface 14*d* of the flange portion 14. Accordingly, it is possible to cut each of the leadout portions 310 and 320 at one time by using the cutting tool 60 and the workability can be enhanced.

Figure 2E:
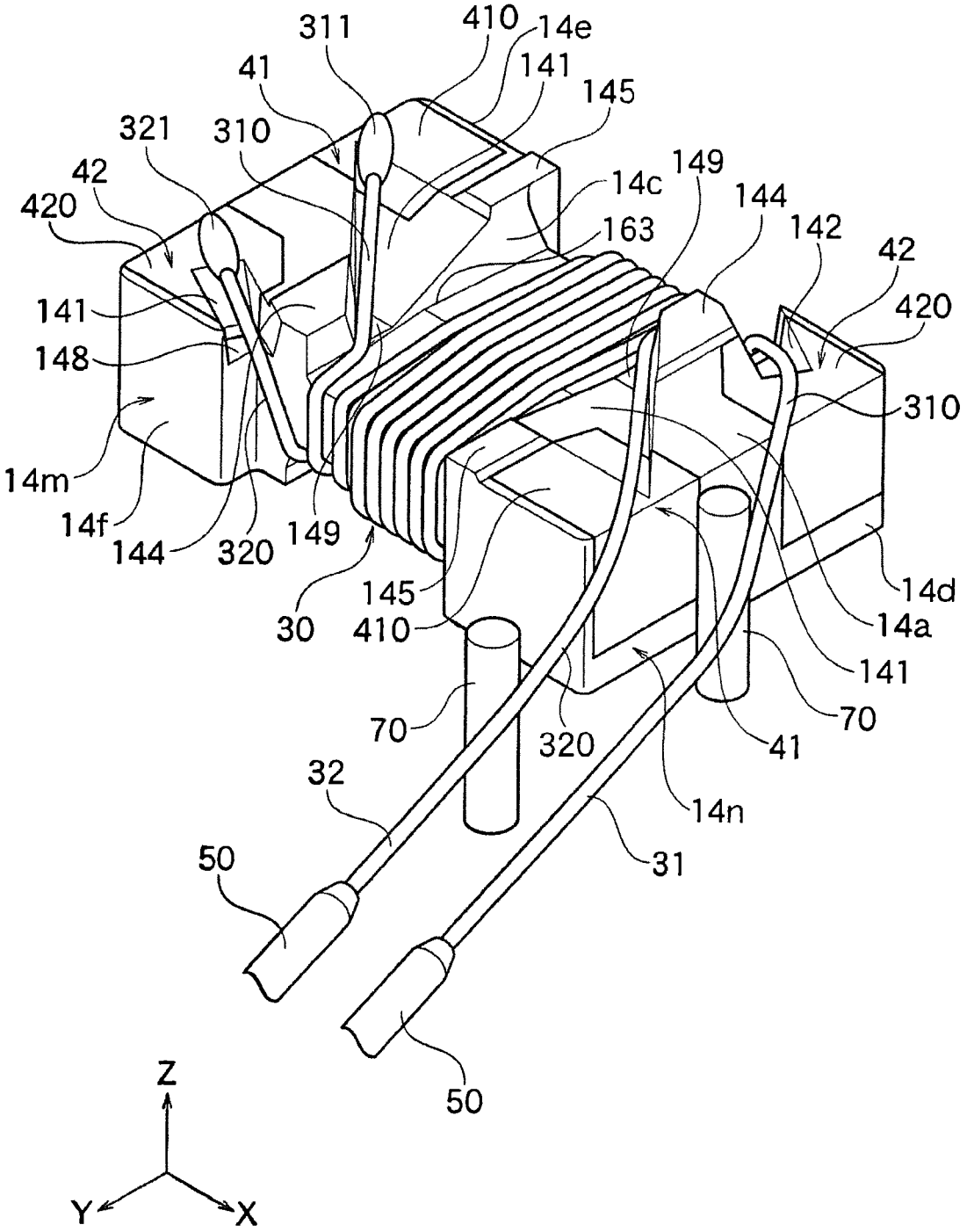
FIG. 2E is a perspective view illustrating a step that follows the step of FIG. 2D.

Next, as illustrated in FIG. 2E, the first wire 31 (first leadout portion 310) on the first flange portion 14*m* side is obliquely drawn out to the midway position of the third concave corner portion 163 in the Y-axis direction while being passed over the step surface 149 along the inclined surface of the first inclined portion 141. Then, the drawn-out first wire 31 is drawn out toward the other end side in the Y-axis direction along the third concave corner portion 163.

It should be noted that the first wire 31 is drawn out while abutting against the first wall-side side surface 1411 of the first inclined portion 141 and the first side surface 1431 of the wall portion 143 illustrated in FIG. 2A.

In addition, the second wire 32 (second leadout portion 320) is drawn out obliquely downward and inward to the end portion of the winding core portion 12 that is on one side in the X-axis direction while being passed over the step surface 148 along the inclined surface of the second inclined portion 142. Subsequently, the wires 31 and 32 are wound to the opposite side (the other end side) of the winding core portion 12 in the X-axis direction and the coil portion 30 is formed.

Then, the second wire 32 (second leadout portion 320) on the second flange portion 14*n* side is drawn out toward the other end side in the Y-axis direction from the end portion of the winding core portion 12 that is on the other side in the X-axis direction to the midway position of the third concave corner portion 163 (not illustrated) in the Y-axis direction. Then, the drawn-out second wire 32 is obliquely drawn out toward the first upper surface electrode portion 410 of the first terminal electrode 41 along the inclined surface of the first inclined portion 141 while being passed over the step surface 149. Subsequently, the second wire 32 is hooked and fixed to a column 70 so as not to loosen. It should be noted that the second wire 32 is drawn out while abutting against the first wall-side side surface 1411 of the first inclined portion 141 and the first side surface 1431 of the wall portion 143 illustrated in FIG. 2A.

At the same time (or subsequently), the first wire 31 (first leadout portion 310) is drawn out obliquely upward from the end portion of the winding core portion 12 that is on the other side in the X-axis direction toward the outside in the X-axis direction and is obliquely drawn out toward the second upper surface electrode portion 420 of the second terminal electrode 42 along the inclined surface of the second inclined portion 142 while being passed over the step surface 148 (not illustrated). Subsequently, the first wire 31 is hooked and fixed to the column 70 so as not to loosen.

Figure 2F:
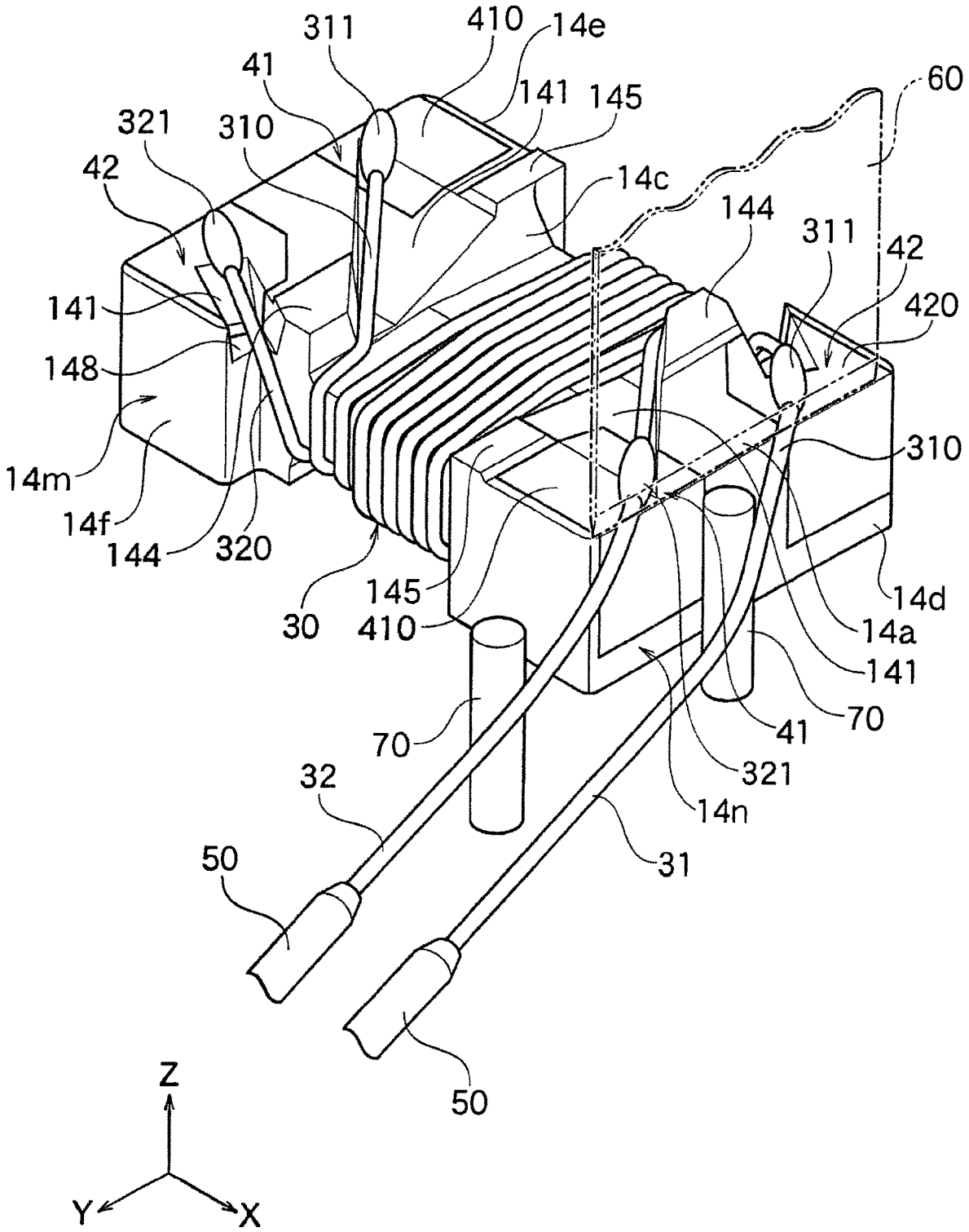
FIG. 2F is a perspective view illustrating a step that follows the step of FIG. 2E.

Next, as illustrated in FIG. 2F, the first wire 31 is connected to the second upper surface electrode portion 420 of the second terminal electrode 42. As a result, the first wire connection portion 311 is formed at the connection part between the second upper surface electrode portion 420 and the first wire 31.

At the same time (or subsequently), the second wire 32 is connected to the first upper surface electrode portion 410 of the first terminal electrode 41. As a result, the second wire connection portion 321 is formed at the connection part between the first upper surface electrode portion 410 and the second wire 32.

Figure 2G:
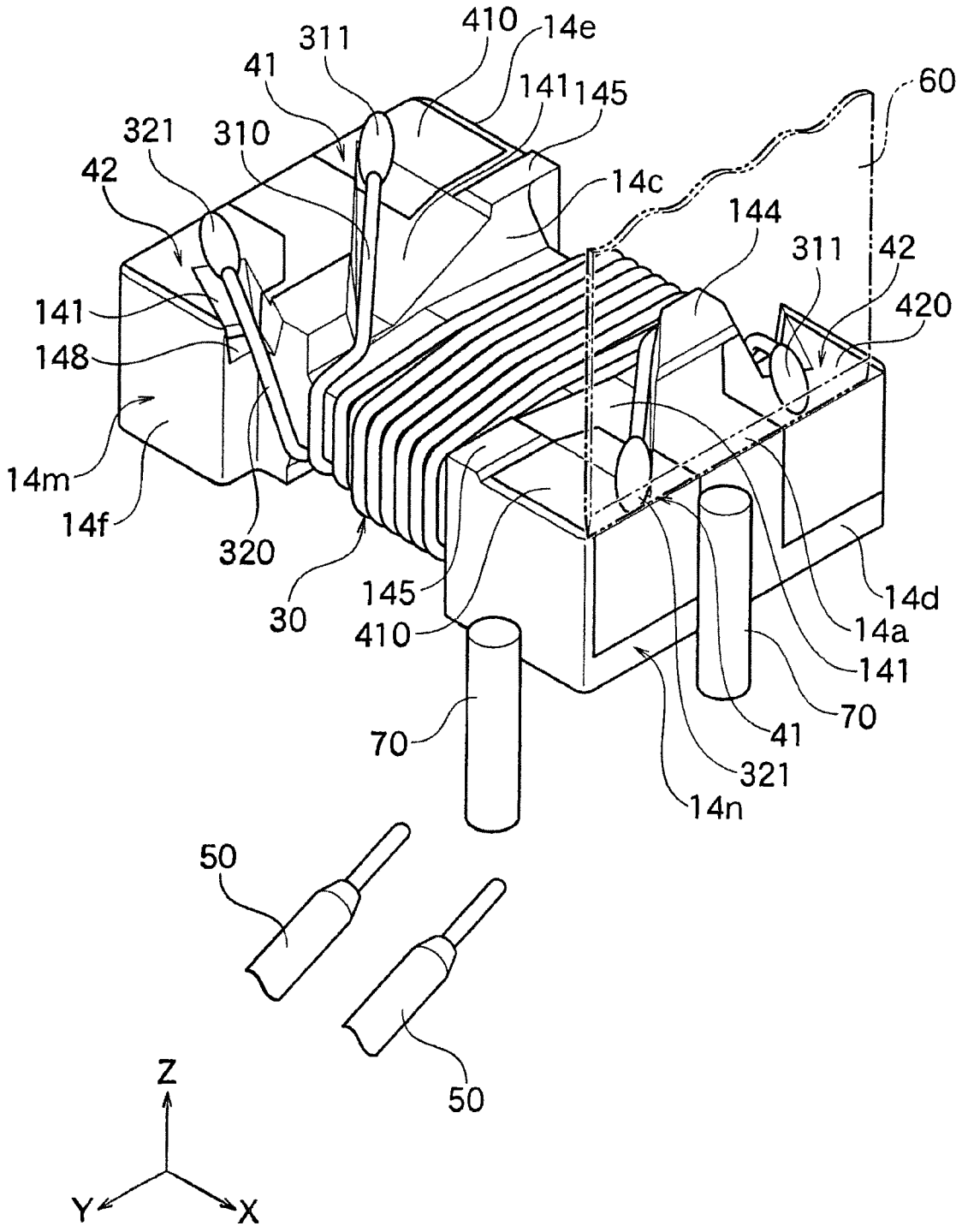
FIG. 2G is a perspective view illustrating a step that follows the step of FIG. 2F.

Next, as illustrated in FIG. 2G, unnecessary parts of the wires 31 and 32 (leadout portions 310 and 320) protruding from the upper surface electrode portions 410 and 420 (terminal electrodes 41 and 42) are cut by means of the cutting tool 60 in a manner similar to the description in FIG. 2D.

Figure 2H:
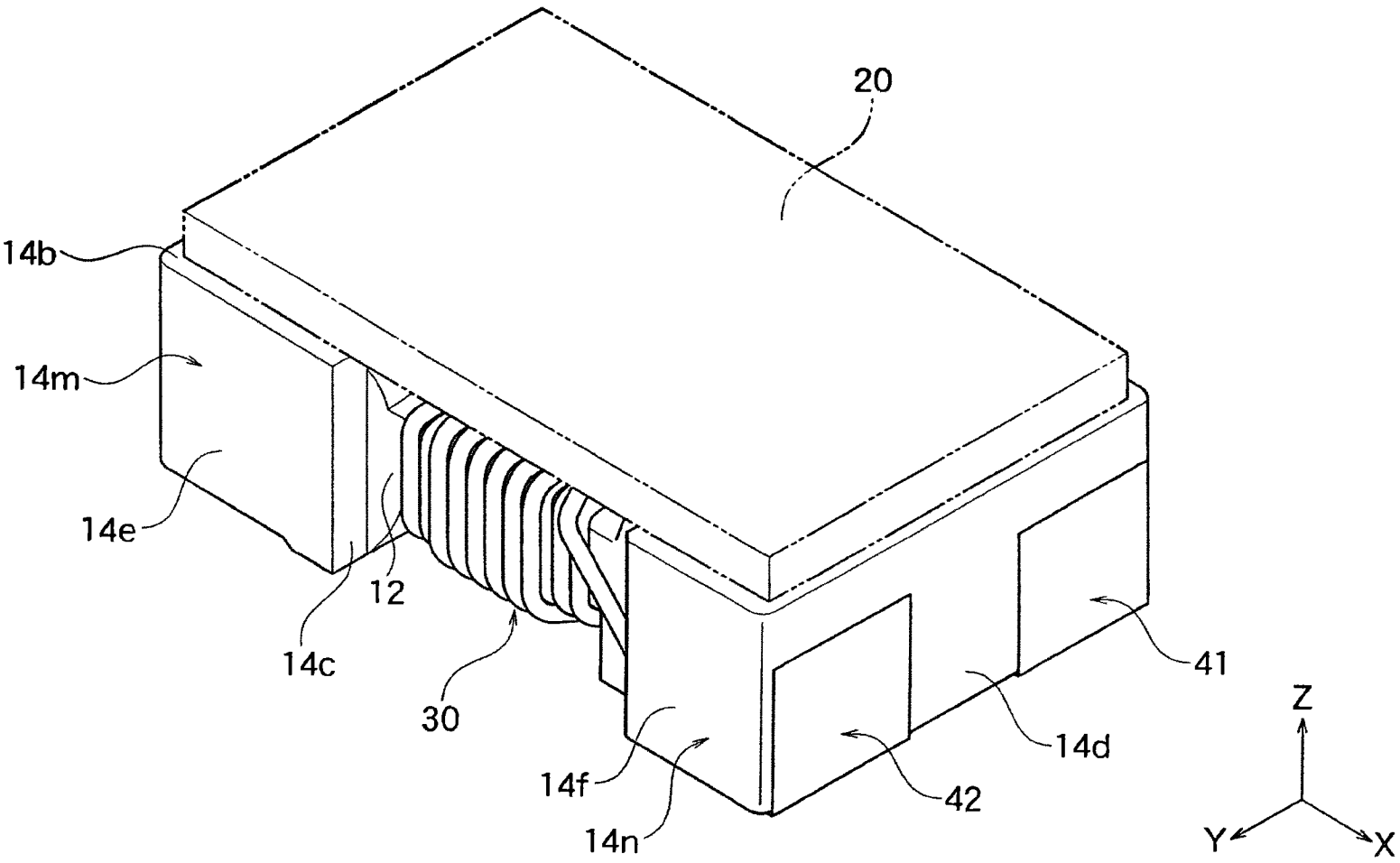
FIG. 2H is a perspective view illustrating a step that follows the step of FIG. 2G.

Next, as illustrated in FIG. 2H, a plate-shaped core 20 is installed on the lower surface 14*b* of the flange portion 14. The lower surface 14*b* is made of a flat surface, and thus the plate-shaped core 20 is installed with ease. The plate-shaped core 20 is made of a flat rectangular parallelepiped having a flat surface and has an inductance enhancement function for the coil device 1. Although it is preferable that the same magnetic material member as the drum core 10 constitutes the plate-shaped core 20, separate members may constitute the drum core 10 and the plate-shaped core 20. It should be noted that the plate-shaped core 20 does not necessarily have to be made of a magnetic material and the plate-shaped core 20 may be made of a non-magnetic material such as synthetic resin.

As illustrated in the drawings including FIG. 1A, the main protuberance 144 is formed on the upper surface 14*a* of the flange portion 14 in the coil device 1 according to the present embodiment. Accordingly, at the position where the main protuberance 144 is formed, the height of the upper surface 14*a* of the flange portion 14 is higher than that around the position and it is difficult for the leadout portions 310 and 320 of the wires 31 and 32 positioned therearound to climb onto the upper surface 14*a* of the flange portion 14. Accordingly, the leadout portions 310 and 320 of the wires 31 and 32 are unlikely to come into contact with each other around the main protuberance 144 and it is possible to prevent the occurrence of a short circuit defect.

In addition and in general, in a case where the leadout portions 310 and 320 of the wires 31 and 32 are loose (lifted), connection of the terminal electrodes 41 and 42 of the upper surface 14*a* to the mounting substrate 80 in that state may lead to contact between the loose part and the mounting substrate 80 and a short circuit defect. However, by the height of the main protuberance 144 being equal to or greater than, for example, a predetermined length, it is possible to shift the positions of the leadout portions 310 and 320 of the wires 31 and 32 to positions separated from the mounting substrate 80 by the distance that corresponds to the amount of protuberating of the main protuberance 144 when the terminal electrodes 41 and 42 of the upper surface 14*a* are connected to the mounting substrate. Accordingly, it is difficult for the loose part to come into contact with the mounting substrate 80 and it is possible to prevent the occurrence of a short circuit defect.

In addition, the second leadout portion 320 of the second wire 32 is connected to the second terminal electrode 42 outside the main protuberance 144 in the X-axis direction in the coil device 1 according to the present embodiment. In this case, the second leadout portion 320 is capable of abutting against (can be fixed to) the periphery (wall portion 143) of the main protuberance 144 and can be drawn out to the second terminal electrode 42 while being positioned at that site. Accordingly, it is possible to stabilize the leadout position of the second leadout portion 320, loosening (lifting) of the second leadout portion 320 is suppressed, and it is difficult for the second leadout portion 320 to climb onto the upper surface 14*a* of the flange portion 14. Accordingly, it is possible to avoid contact between the leadout portions 310 and 320 of the wires 31 and 32 and prevent the occurrence of a short circuit defect.

In addition, the main protuberance 144 is positioned inside the region sandwiched between the first leadout portion 310 of the first wire 31 and the second leadout portion 320 of the second wire 32. Accordingly, the first leadout portion 310 drawn out on one side across the main protuberance 144 and the second leadout portion 320 drawn out on the other side across the main protuberance 144 are unlikely to climb onto the upper surface 14*a* of the flange portion 14 and it is possible to avoid contact between the leadout portions 310 and 320 and effectively prevent the occurrence of a short circuit defect.

In addition, the sub protuberance 145 as well as the main protuberance 144 is formed on the upper surface 14*a* and the sub protuberance 145 is positioned on one end side in the Y-axis direction. Accordingly, it is possible to align the maximum height of the upper surface 14*a* of the flange portion 14 on one end side in the Y-axis direction where the sub protuberance 145 is positioned and the other end side in the Y-axis direction where the main protuberance 144 is positioned and the coil device 1 can be stably connected onto the mounting substrate 80.

In addition, the first inclined portion 141 extending at an angle in the Z-axis direction with respect to the Y-axis direction is formed in the flange portion 14. Accordingly, the first leadout portion 310 of the first wire 31 can be drawn out to the first terminal electrode 41 along the first inclined portion 141. In addition, at the position where the first inclined portion 141 is formed, the inside corner portion of the flange portion 14 (corner portion formed by the upper surface 14*a* and the inner end surface 14*c*) is removed, and thus it is possible to prevent a situation in which the first leadout portion 310 is caught in the corner portion and the insulation coating thereof is damaged when the first leadout portion 310 is drawn out from the winding core portion 12 side toward the first terminal electrode 41.

In addition, as illustrated in FIG. 2B, the first inclined portion 141 has the first inclined surface 1410 increasing in width in the X-axis direction from the starting end 141*s* toward the terminal end 141*e* and the first inclined surface 1410 is formed from the vicinity of the outer end surface 14*d* of the flange portion 14 to the inner end surface 14*c* of the flange portion 14 in the terminal end portion 141*e* of the first inclined portion 141. Accordingly, an inclined surface that is deeply inclined from the X-axis-direction inner side of the flange portion 14 to the X-axis-direction outer side of the flange portion 14 is formed and it is possible to draw out the first leadout portion 310 of the first wire 31 to the vicinity of the outer end surface 14*d* of the flange portion 14 along the first inclined portion 141 as illustrated in the drawings including FIG. 1A.

The first leadout portion 310 is drawn out to the vicinity of the outer end surface 14*d* of the flange portion 14 as described above. As a result, the first leadout portion 310 is capable of abutting against (can be fixed to) the periphery ($_{w}$all portion 143) of the main protuberance 144 and can be drawn out to the first terminal electrode 41 so as to be along the periphery (wall portion 143) of the main protuberance 144 while being positioned at that site as described above. Accordingly, it is possible to stabilize the leadout position of the first leadout portion 310, loosening (lifting) of the first leadout portion 310 is suppressed, and it is difficult for the first leadout portion 310 to climb onto the upper surface 14*a* of the flange portion 14. Accordingly, it is possible to avoid contact between the leadout portions 310 and 320 of the wires 31 and 32 and effectively prevent the occurrence of a short circuit defect.

In addition, the second inclined portion 142 extending at an angle different from that of the first inclined portion 141 is formed in the flange portion 14 and the main protuberance 144 is positioned inside the region sandwiched between the first inclined portion 141 and the second inclined portion 142. Accordingly, the first leadout portion 310 of the first wire 31 drawn out along the first inclined portion 141 positioned on one side across the main protuberance 144 and the second leadout portion 320 of the second wire 32 drawn out along the second inclined portion 142 positioned on the other side across the main protuberance 144 are unlikely to climb onto the upper surface 14*a* of the flange portion 14 and it is possible to avoid contact between the leadout portions 310 and 320 of the wires 31 and 32 and effectively prevent the occurrence of a short circuit defect.

In addition, as illustrated in FIG. 4, the width W2A of the upper surface 14*a* side of the flange portion 14 along the X-axis direction is larger than the width W2B of the lower surface 14*b* side of the flange portion 14 along the X-axis direction. Accordingly, the volume of the flange portion 14 can be larger than in a case where the X-axis-direction widths of the upper surface 14*a* side of the flange portion 14 and the lower surface 14*b* side of the flange portion 14 are equal to each other and it is possible to realize the coil device 1 that has satisfactory inductance characteristics.

In addition, on the lower surface 14*b* side, the inner end surface 14*c* of the flange portion 14 is disposed on the outer side in the X-axis direction as compared with the upper surface 14*a* side. Accordingly, as illustrated in the drawings including FIG. 1A, it is possible to separate the leadout positions of the first leadout portion 310 of the first wire 31 extending from the upper surface 14*a* side toward the first terminal electrode 41 and the second leadout portion 320 of the second wire 32 extending from the lower surface 14*b* side toward the second terminal electrode 42, avoid contact between the leadout portions 310 and 320 of the wires 31 and 32, and effectively prevent the occurrence of a short circuit defect.

In addition, for example, the first leadout portion 310 can be fixed to the vicinity of the inner end surface 14*c* of the flange portion 14 on the upper surface 14*a* side (upper surface side of the winding core portion 12) and the second leadout portion 320 can be fixed to the vicinity of the inner end surface 14*c* of the flange portion 14 on the lower surface 14*b* side (lower surface side of the winding core portion 12), and thus the respective leadout portions 310 and 320 of the wires 31 and 32 can be positioned with ease.

It should be noted that the invention is not limited to the above-described embodiment and the invention can be variously modified within the scope of the invention.

In the above embodiment, the main protuberance 144 is not limited to one and may be two or more in number. For example, in a case where three wires constitute the coil portion 30, the main protuberance may be formed inside each of the regions that are sandwiched by the respective leadout portions of the three wires. In addition, the same applies to the sub protuberance 145 and the sub protuberance 145 may be two or more in number.

The second terminal electrode 42 may be formed so as to straddle the main protuberance 144 although the second terminal electrode 42 is not formed on the upper surface of the main protuberance 144 in the above embodiment. In addition, the first terminal electrode 41 may be formed so as to straddle the sub protuberance 145 although the first terminal electrode 41 is not formed on the upper surface of the sub protuberance 145 in the above embodiment.

Terminal fittings may constitute the terminal electrodes 41 and 42 in the above embodiment. For example, the terminal electrodes 41 and 42 may be configured by L-shaped terminal fittings being fixed by means of a connection member such as an adhesive so as to straddle the upper surface 14*a* and the outer end surface 14*d* of the flange portion 14.

In the above embodiment, a part of the second wire connection portion 321 of the second leadout portion 320 protrudes upward beyond the upper surface of the main protuberance 144 when the second leadout portion 320 of the second wire 32 is connected to the second upper surface electrode portion 420. Alternatively, the second wire connection portion 321 may be disposed at the same height as the upper surface of the main protuberance 144 or below the upper surface of the main protuberance 144. In addition, in the above embodiment, a part of the first wire connection portion 311 of the first leadout portion 310 protrudes upward beyond the upper surface of the sub protuberance 145 when the first leadout portion 310 of the first wire 31 is connected to the first upper surface electrode portion 410. Alternatively, the first wire connection portion 311 may be disposed at the same height as the upper surface of the sub protuberance 145 or below the upper surface of the sub protuberance 145.

When the coil device 1 is mounted on the mounting substrate 80 in this case and in FIG. 5, the main protuberance 144 and the sub protuberance 145 abut against the mounting substrate 80 and the wire connection portions 311 and 321 (upper surface electrode portions 410 and 420) are disposed at the positions that are separated upward by a predetermined distance from the land 81 of the mounting substrate 80 by the distance that corresponds to the amount of protuberating of the main protuberance 144 and the sub protuberance 145. At this time, it is preferable to set the heights of the main protuberance 144 and the sub protuberance 145 such that the wire connection portions 311 and 321 are not excessively separated from the land 81 of the mounting substrate 80. As a result, the wire connection portions 311 and 321 and the land 81 of the mounting substrate 80 can be satisfactorily connected to each other via the connection member 90.

In the above embodiment, the first inclined portion 141 and the second inclined portion 142 are inessential and the first inclined portion 141 and the second inclined portion 142 may be omitted from the configuration of the core 10. In addition, the sub protuberance 145 is inessential and the sub protuberance 145 may be omitted from the configuration of the core 10.

In the above embodiment, the first leadout portions 310 of the first wire 31 may be connected to the first terminal electrode 41 of the first flange portion 14*m* and the first terminal electrode 41 of the second flange portion 14*n*, respectively. Likewise, the second leadout portions 320 of the second wire 32 may be connected to the second terminal electrode 42 of the first flange portion 14*m* and the second terminal electrode 42 of the second flange portion 14*n*, respectively. In this case, the positional relationship of the first wire 31 and the second wire 32 may be reversed from the example illustrated in FIG. 1A by, for example, the first wire 31 and the second wire 32 intersecting with each other (the pair of wires 31 and 32 being twisted) before or after the coil portion 30 is formed.

In the above embodiment, the range of the first upper surface electrode portion 410 illustrated in FIG. 1B may be extended to the Y-axis-direction outside of the flange portion 14 and the Y-axis-direction end portion of the upper surface 14*a* may be covered with the first upper surface electrode portion 410. In addition, the range of the first side surface electrode portion 411 may be extended to the Y-axis-direction outside of the flange portion 14 and the Y-axis-direction end portion of the outer end surface 14*d* may be covered with the first side surface electrode portion 411.

Likewise, the range of the second upper surface electrode portion 420 may be extended to the Y-axis-direction outside of the flange portion 14 and the Y-axis-direction end portion of the upper surface 14*a* may be covered with the second upper surface electrode portion 420. In addition, the range of the second side surface electrode portion 421 may be extended to the Y-axis-direction outside of the flange portion 14 and the Y-axis-direction end portion of the outer end surface 14*d* may be covered with the second side surface electrode portion 421.

Figure 3:
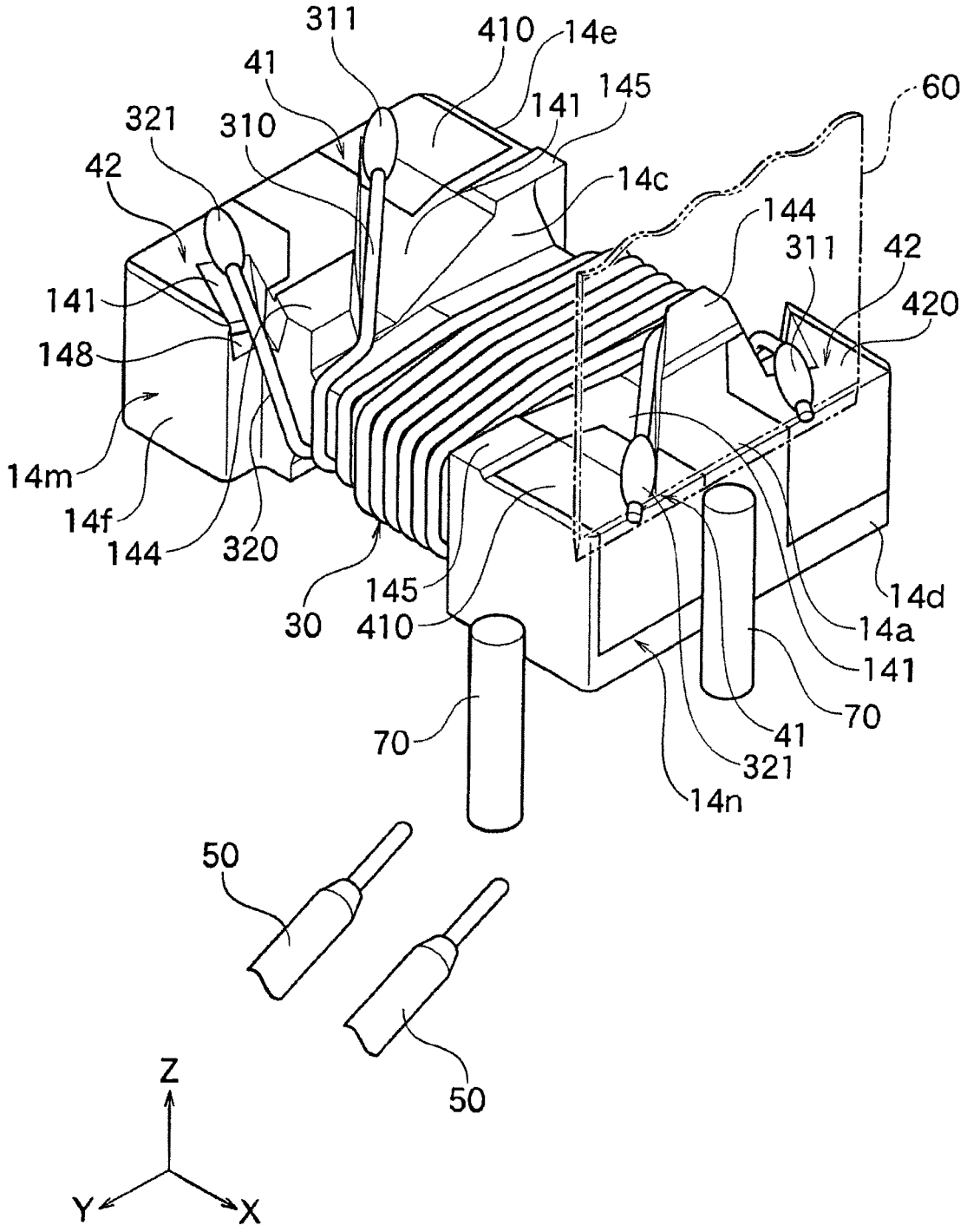
FIG. 3 is a perspective view illustrating a modification example of the step illustrated in FIG. 2G.

In the above embodiment, the cutting of the unnecessary parts of the wires 31 and 32 (leadout portions 310 and 320) may be performed at a position that is separated to the X-axis-direction outside from the outer end surface 14*d* of the flange portion 14 as compared with the position illustrated in FIG. 2G. At that time, the unnecessary parts of the wires 31 and 32 may be left ahead of the wire connection portions 311 and 321 as illustrated in FIG. 3.

Although the above embodiment illustrates the coil device 1 that has the two-layer coil portion 30 as illustrated in FIG. 1A, the number of layers of the coil portion 30 may be three or more or may be one.

In the above embodiment, a step surface having a substantially planar shape constitutes the step surface 148 as illustrated in FIG. 2A. Alternatively, a curved step surface may constitute the step surface 148.

Exemplified in the above embodiment is a case where the first upper surface electrode portion 410 and the first side surface electrode portion 411 constitute the first terminal electrode 41 as illustrated in FIG. 2B. Alternatively, the first side surface electrode portion 411 may be omitted. The same applies to the second terminal electrode 42 and the second side surface electrode portion 421 may be omitted.

In the above embodiment, the upper surface 14*a* of the flange portion 14 is a mounting surface. Alternatively, the lower surface 14*b* may be a mounting surface with the plate-shaped core 20 installed on the upper surface 14*a*.

In the above embodiment, the wires 31 and 32 are hooked and fixed to the outer peripheral surface that is on one side (front side toward the paper surface) of the columns 70 and 70 as illustrated in FIG. 2E. Alternatively, the wires 31 and 32 may be hooked and fixed to the outer peripheral surface that is on the other side of the columns 70 and 70 (back side toward the paper surface).

What is claimed is:

1. A coil device comprising:

a core including a winding core portion and a flange portion at an end portion of the winding core portion in a first direction;

a coil portion (i) comprised of wires wound around the winding core portion and (ii) having a coil axis in the first direction; and spaced terminal electrodes on the flange portion, leadout portions of the wires being connected to the terminal electrodes, wherein the flange portion has (i) a first, substantially flat, non-inclined surface that bears the terminal electrodes and (ii) a main protuberance that (a) is adjacent to the first surface and (b) extends outwardly from the first surface in a direction perpendicular to the first surface; and the leadout portions of the wires are connected to the terminal electrodes at the first surface such that the leadout portions are outward of the main protuberance in the first direction.

2. The coil device according to claim 1, wherein the main protuberance is between one of the leadout portions of the wires and another one of the leadout portions of the wires when viewed in the first direction.

3. The coil device according to claim 1, wherein the flange portion includes a sub protuberance that (i) is adjacent to the first surface, (ii) extends outwardly from the first surface in the direction perpendicular to the first surface, and (iii)

is on one end side in a second direction perpendicular to the first direction spaced from the main protuberance.

4. The coil device according to claim 2, wherein the flange portion includes a sub protuberance that (i) is adjacent to the first surface, (ii) extends outwardly from the first surface in the direction perpendicular to the first surface, and (iii) is on one end side in a second direction perpendicular to the first direction spaced from the main protuberance.

5. The coil device according to claim 1, wherein the flange portion includes a first inclined portion that is at an angle to be inclined with respect to a second direction perpendicular to the first direction toward a third direction perpendicular to the first direction and the second direction.

6. The coil device according to claim 2, wherein the flange portion includes a first inclined portion that is at an angle to be inclined with respect to a second direction perpendicular to the first direction toward a third direction perpendicular to the first direction and the second direction.

7. The coil device according to claim 3, wherein the flange portion includes a first inclined portion that is at an angle to be inclined with respect to the second direction toward a third direction perpendicular to the first direction and the second direction.

8. The coil device according to claim 4, wherein the flange portion includes a first inclined portion that is at an angle to be inclined with respect to the second direction toward a third direction perpendicular to the first direction and the second direction.

9. The coil device according to claim 5, wherein the first inclined portion has an inclined surface increasing in width in the first direction from a starting end of the first inclined portion toward a terminal end of the first inclined portion, and the inclined surface has a width extending from a vicinity of an outer end surface of the flange portion to an inner end surface of the flange portion at a portion of the terminal end of the first inclined portion.

10. The coil device according to claim 6, wherein the first inclined portion has an inclined surface increasing in width in the first direction from a starting end of the first inclined portion toward a terminal end of the first inclined portion, and the inclined surface has a width extending from a vicinity of an outer end surface of the flange portion to an inner end surface of the flange portion at a portion of the terminal end of the first inclined portion.

11. The coil device according to claim 7, wherein the first inclined portion has an inclined surface increasing in width in the first direction from a starting end of the first inclined portion toward a terminal end of the first inclined portion, and the inclined surface has a width extending from a vicinity of an outer end surface of the flange portion to an inner end surface of the flange portion at a portion of the terminal end of the first inclined portion.

12. The coil device according to claim 8, wherein the first inclined portion has an inclined surface increasing in width in the first direction from a starting end of the first inclined portion toward a terminal end of the first inclined portion, and the inclined surface has a width extending from a vicinity of an outer end surface of the flange portion to an inner end surface of the flange portion at a portion of the terminal end of the first inclined portion.

13. The coil device according to claim 5, wherein the flange portion includes a second inclined portion that is at an angle with respect to the second direction different from the angle of the first inclined portion, and the main protuberance is between the first inclined portion and the second inclined portion.

14. The coil device according to claim 6, wherein the flange portion includes a second inclined portion that is at an angle with respect to the second direction different from the angle of the first inclined portion, and the main protuberance is between the first inclined portion and the second inclined portion.

15. The coil device according to claim 7, wherein
the flange portion includes a second inclined portion that is at an angle with respect to the second direction different from the angle of the first inclined portion, and
the main protuberance is between the first inclined portion and the second inclined portion.

16. The coil device according to claim 9, wherein
the flange portion includes a second inclined portion that is at an angle with respect to the second direction different from the angle of the first inclined portion, and
the main protuberance is between the first inclined portion and the second inclined portion.

17. The coil device according to claim 1, wherein a width of the flange portion along the first direction at a side of the first surface is larger than a width of the flange portion along the first direction at a side of a second surface that is opposite to the first surface.

18. The coil device according to claim 2, wherein a width of the flange portion along the first direction at a side of the first surface is larger than a width of the flange portion along the first direction at a side of a second surface that is opposite to the first surface.

19. The coil device according to claim 3, wherein a width of the flange portion along the first direction at a side of the first surface is larger than a width of the flange portion along the first direction at a side of a second surface that is an opposite to the first surface.

20. The coil device according to claim 5, wherein a width of the flange portion along the first direction at a side of the first surface is larger than a width of the flange portion along the first direction at a side of a second surface that is opposite to the first surface.

* * * * *